US005957068A

United States Patent [19]

Mizuno

[11] Patent Number: 5,957,068

[45] Date of Patent: Sep. 28, 1999

[54] EMBROIDERY DATA PROCESSING APPARATUS AND METHOD OF PRODUCING EMBROIDERY DATA

[75] Inventor: Masahiro Mizuno, Nagoya, Japan

[73] Assignee: Brother Koygo Kabushiki Kaisha, Nagoya, Japan

[21] Appl. No.: 09/005,839

[22] Filed: Jan. 12, 1998

Related U.S. Application Data

[63] Continuation-in-part of application No. 08/990,814, Dec. 15, 1997, Pat. No. 5,823,127, application No. 08/990,816, Dec. 15, 1997, and application No. 08/990,733, Dec. 15, 1997.

[30] Foreign Application Priority Data

Jan. 13, 1997 [JP] Japan ..... 9-003609

[51] Int. Cl.[6] ..... D05C 5/04

[52] U.S. Cl. ..... 112/102.5; 364/470.09

[58] Field of Search ..... 112/102.5, 470.06, 112/475.19, 470.04, 454, 456, 458; 364/470.09

[56] References Cited

U.S. PATENT DOCUMENTS

| | | | |
|---|---|---|---|
| 5,283,748 | 2/1994 | Muramatsu | 112/102.5 X |
| 5,299,514 | 4/1994 | Hayakawa et al. . | |
| 5,320,054 | 6/1994 | Asano | 112/103 X |
| 5,576,968 | 11/1996 | Mizuno et al. . | |

*Primary Examiner*—Peter Nerbun

*Attorney, Agent, or Firm*—Oliff & Berridge, PLC

[57] ABSTRACT

An embroidery data processing apparatus for sewing an embroidery pattern, where an outline that defines the shape of an embroidery area intersects with itself at a point or points, the outline is divided into a plurality of segmental outlines at self-intersecting points, such that a plurality of segmental closed areas are defined by the segmental outlines. An underlying stitch area outline is established in the interior of each of the segmental closed areas, and underlying stitch data is produced for each segmental closed area. Thus, the apparatus of the invention can produce appropriate sewing data for forming underlying stitches even where the outline that defines the shape of the embroidery area intersects with itself.

20 Claims, 14 Drawing Sheets

EMBROIDERY DATA PROCESSING APPARATUS AND METHOD OF PRODUCING EMBROIDERY DATA

This application is a Continuation-in-Part Application of Ser. No. 08/990,816 (Attorney Docket No. JAO 30741); Ser. No. 08/990,814, now U.S. Pat. No. 5,823,127 (Attorney Docket No. JAO 30742); and Ser. No. 08/990,733 (Attorney Docket No. JAO 30743), all filed Dec. 15, 1997, the disclosures of which are incorporated herein by reference.

BACKGROUND OF THE INVENTION

1. Field of Invention

The invention relates to an embroidery data processing apparatus capable of producing sewing data used for forming underlying stitches in an embroidery area, and also relates to a method of producing embroidery data.

2. Description of Related Art

Conventionally, sewing data for forming stitches in an embroidery pattern was produced by determining coordinates of the positions where each needle is dropped. In recent years, an embroidery data processing apparatus has been developed and widely used which is able to semiautomatically produce sewing data for forming an embroidery pattern, by defining a set of embroidery data that specify the shape, position and size of an embroidery area, direction of stitches and thread density in the area, and the like. Where embroidering is performed to fill or cover the interior of a closed area with stitches, in particular, underlying stitches may be formed in order to make the embroidered area three-dimensional or swollen, and to prevent a work cloth from shrinking, or being drawn together by the stitches, as the embroidering operation proceeds. Thus, an apparatus for producing and processing sewing data for forming underlying stitches has been proposed and used in general. In a known method of producing such sewing data for forming underlying stitches, an underlying stitch area outline that defines the shape of an area in which underlying stitches are formed is produced or drawn inside a closed area that is enclosed by an outline for defining the shape of an embroidery area, and sewing data for forming underlying stitches is produced based on the underlying stitch area outline. Such a device is disclosed in U.S. Pat. No. 5,299,514, the disclosure of which is incorporated by reference herein.

If the known method of producing sewing data as described above is applied to the case where the outline defining the shape of the embroidery area intersects with itself at a point or points, however, the underlying stitch area outline defining the shape of the area in which underlying stitches are formed may be drawn outside the embroidery area, as shown in FIG. 10, thus making it impossible to produce sewing data for forming underlying stitches appropriately go.

SUMMARY OF THE INVENTION

It is therefore an object of the invention to provide an embroidery data processing apparatus capable of producing sewing data for forming appropriate underlying stitches even in the case where an outline that defines the shape of an embroidery area intersects with itself, and to provide a method of producing such embroidery data.

The above object may be accomplished according to the principle of the invention, which provides an embroidery data processing apparatus for producing embroidery data used for forming underlying stitches in a closed area that is enclosed by an outline that defines a shape of an embroidery area, the apparatus comprising dividing means for dividing the outline into a plurality of segmental outlines at at least one self-intersecting point at which the outline intersects with itself, the segmental outlines defining a plurality of segmental closed areas, respectively, which are connected to each other at the at least one self-intersecting point; underlying stitch outline setting means for establishing a plurality of segmental underlying stitch area outlines that define respective shapes of a plurality of segmental underlying stitch areas in which underlying stitches are formed, such that each of the segmental underlying stitch areas is located inside a corresponding one of the plurality of segmental closed areas defined by the segmental outlines into which the outline is divided by the dividing means; and underlying stitch data producing means for producing segmental underlying stitch data used for forming underlying stitches in each of the plurality of segmental underlying stitch areas defined by the segmental underlying stitch area outlines.

In the embroidery processing apparatus according to the invention, where the outline defining the shape of the embroidery area intersects with itself at at least one self-intersecting point, the dividing means divides the outline at the at least one self-intersecting point into a plurality of segmental outlines that defines a plurality of segmental closed areas. Then, the segmental underlying stitch area outline setting means establishes segmental underlying stitch area outlines that define respective shapes of the areas in which underlying stitching is performed, such that each of the underlying stitch area outlines is located inside a corresponding one of the segmental closed areas defined by the segmental outlines into which the above outline is divided. Subsequently, the segmental underlying stitch data producing means produces the segmental underlying stitch data for each of the segmental underlying stitch areas defined by the segmental underlying stitch area outlines. Thus, the apparatus of the invention is able to produce sewing data for forming appropriate underlying stitches even where the outline intersects with itself at a point or points.

The embroidery data processing apparatus of the invention may further include segmental underlying stitching start and end point setting means for setting a segmental underlying stitching start point and a segmental underlying stitching end point for each of the plurality of segmental underlying stitch areas. By setting the segmental underlying stitching start point and segmental underlying stitching end point by this underlying stitching start and end point setting means, the invention is able to produce sewing data with which underlying stitches can be very efficiently formed in each of the segmental underlying stitch areas.

The embroidery data processing apparatus of the invention may further include means for determining the sewing order in each of the segmental closed areas, such that immediately after underlying stitches are formed in one of the segmental underlying stitch areas, stitches are formed in one of the segmental closed areas that contains the above-indicated one of the segmental underlying stitch areas. Namely, after stitching of one segmental closed area is completed, stitching of the next segmental closed area is started, thus eliminating a need to go back and forth between the plural segmental closed areas. Thus, the apparatus of this invention is able to produce sewing data that enables highly efficient stitching operations.

The embroidery data processing apparatus of the invention may further include means for determining the sewing order between the plurality of segmental closed areas. Namely, sewing data that permits continuous and efficient stitching over a plurality of segmental closed areas can be produced based on the sewing order determined by the sewing order determining means.

The embroidery data processing apparatus of the invention may further include connecting relationship storing means for storing a connecting relationship between the plurality of segmental closed areas, and auxiliary sewing data producing means for producing auxiliary sewing data used for forming continuous stitches over the plurality of segmental closed areas, based on the connecting relationship between the segmental closed areas stored in the connecting relationship storing means. Thus, the apparatus of the invention is able to produce sewing data with which stitches can be continuously formed over the plurality of segmental closed areas with high efficiency.

Also, the embroidery data processing apparatus of the invention may further include underlying stitching setting means for setting each of the plurality of segmental closed areas to a selected value that indicates whether underlying stitches are to be formed, and set value storing means for storing the selected value to which each segmental closed area is set by the underlying stitching setting means. In this case, the underlying stitching setting means can set each of the segmental closed areas as to whether the underlying stitching is to be performed in that area.

In the embroidery data processing apparatus as described above, the underlying stitch outline setting means may establish each of the segmental underlying stitch area outlines, based on the selected value stored in the set value storing means with respect to a corresponding one of the segmental closed areas. Thus, the apparatus of the invention is able to produce sewing data for forming underlying stitches only for the segmental closed areas that have been set to be provided with underlying stitches.

The embroidery data processing apparatus of the invention may further include selecting means for selecting at least one segmental closed area from the plurality of segmental closed areas. It is thus possible to select an arbitrary segmental closed area by the selecting means, and set the selected segmental closed area to a selected one of the values indicating whether underlying stitches are to be formed.

According to another aspect of the invention, there is provided a method of producing an embroidery data used for forming underlying stitches in a closed area that is enclosed by an outline that defines a shape of an embroidery area, comprising the steps of dividing the outline into a plurality of segmental outlines at at least one self-intersecting point at which the outline intersects with itself, the segmental outlines defining a plurality of segmental closed areas, respectively, which are connected to each other at the at least one self-intersecting point; establishing a plurality of segmental underlying stitch area outlines that define respective shapes of a plurality of segmental underlying stitch areas in which underlying stitches are formed, such that each of the segmental underlying stitch areas is located inside a corresponding one of the plurality of segmental closed areas defined by the segmental outlines into which the outline is divided; and producing segmental underlying stitch data used for forming underlying stitches in each of the plurality of segmental underlying stitch areas defined by the segmental underlying stitch area outlines.

The embroidery data producing method of the invention may further include a step of setting a segmental underlying stitching start point and a segmental underlying stitching end point for each of the plurality of segmental underlying stitch areas, and/or a step of determining a sewing order in each of the segmental closed areas, such that immediately after underlying stitches are formed in one of the segmental underlying stitch areas, stitches are formed in one of the segmental closed areas that contains the above-indicated one segmental underlying stitch area. The embroidery data producing method may also include a step of determining a sewing order between the plurality of segmental closed areas.

BRIEF DESCRIPTION OF THE DRAWINGS

A preferred embodiment of the invention will be described in detail with reference to the following figures wherein.

DETAILED DESCRIPTION OF PREFERRED EMBODIMENTS

Figure 1:
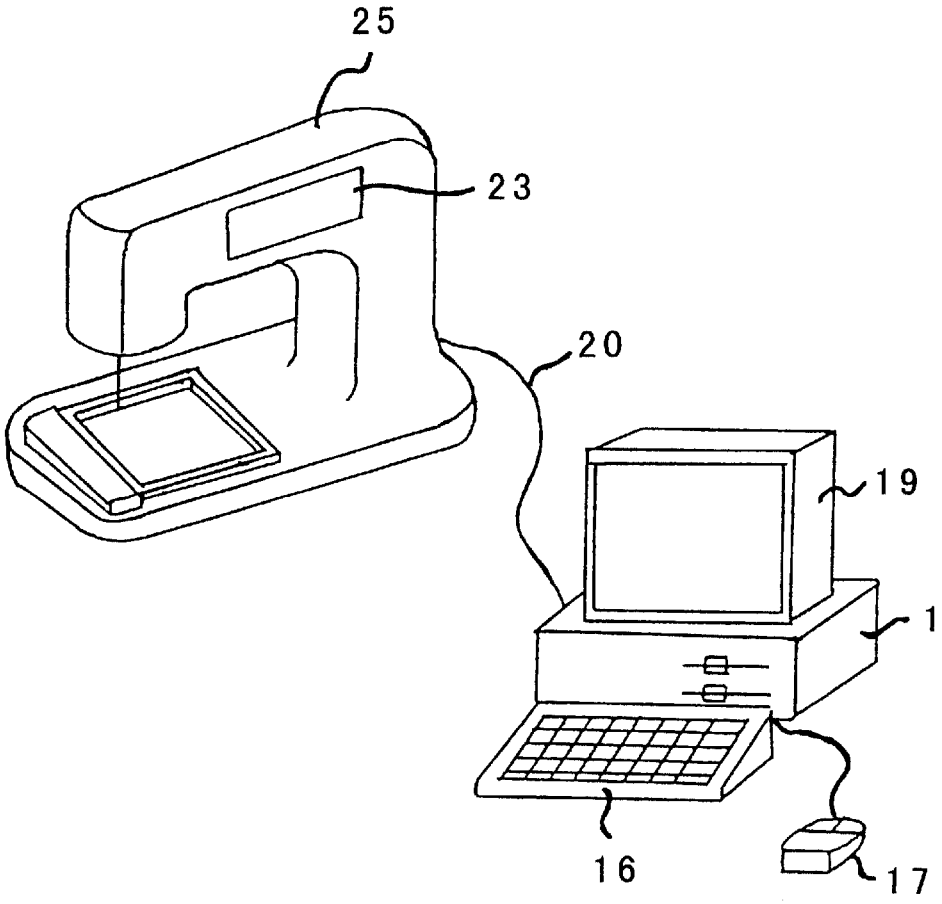
FIG. 1 is a perspective view of the overall arrangement of an embroidery sewing machine and an embroidery data processing apparatus according to an embodiment of the invention.

A preferred embodiment of the invention will be described in detail hereinafter with reference to the accompanying drawings.

The embroidery sewing machine used together with an embodiment of the embroidery data processing apparatus will be briefly described, although not detailed in the drawings. The embroidery sewing machine forms an embroidery pattern in a work cloth held by an embroidery frame disposed on a bed, by operating a horizontal motion mechanism to move the embroidery frame to predetermined positions indicated by the X-Y coordinate system provided specifically for the sewing machine while operating a sewing needle and a shuttle mechanism to stitch.

The horizontal motion mechanism, the needle bar and the like are controlled by a control device formed of a microcomputer and the like. The control device receives embroidering stitch (needle pierce) data that designates a displacement (needle pierce position) of the work cloth in the X and Y-directions for each stitch and, thereby, is able to automatically perform the embroidering operation. In this embodiment, the embroidery sewing machine is equipped with a communication device for receiving embroidery stitch data from an external device. The embroidery data processing apparatus of this embodiment has a function for generating such embroidery stitch data.

FIG. 1 shows the overall arrangement of a sewing machine and an embroidery data processing apparatus according to the embodiment. The embroidery sewing machine 25 is structured to receive embroidery data from a personal computer 1 through a communication cable 20. The embroidery sewing machine 25 has a display 23 for displaying various messages, such as a message to instruct a user to change the embroidery thread to a different-color thread, and the like.

Figure 2:
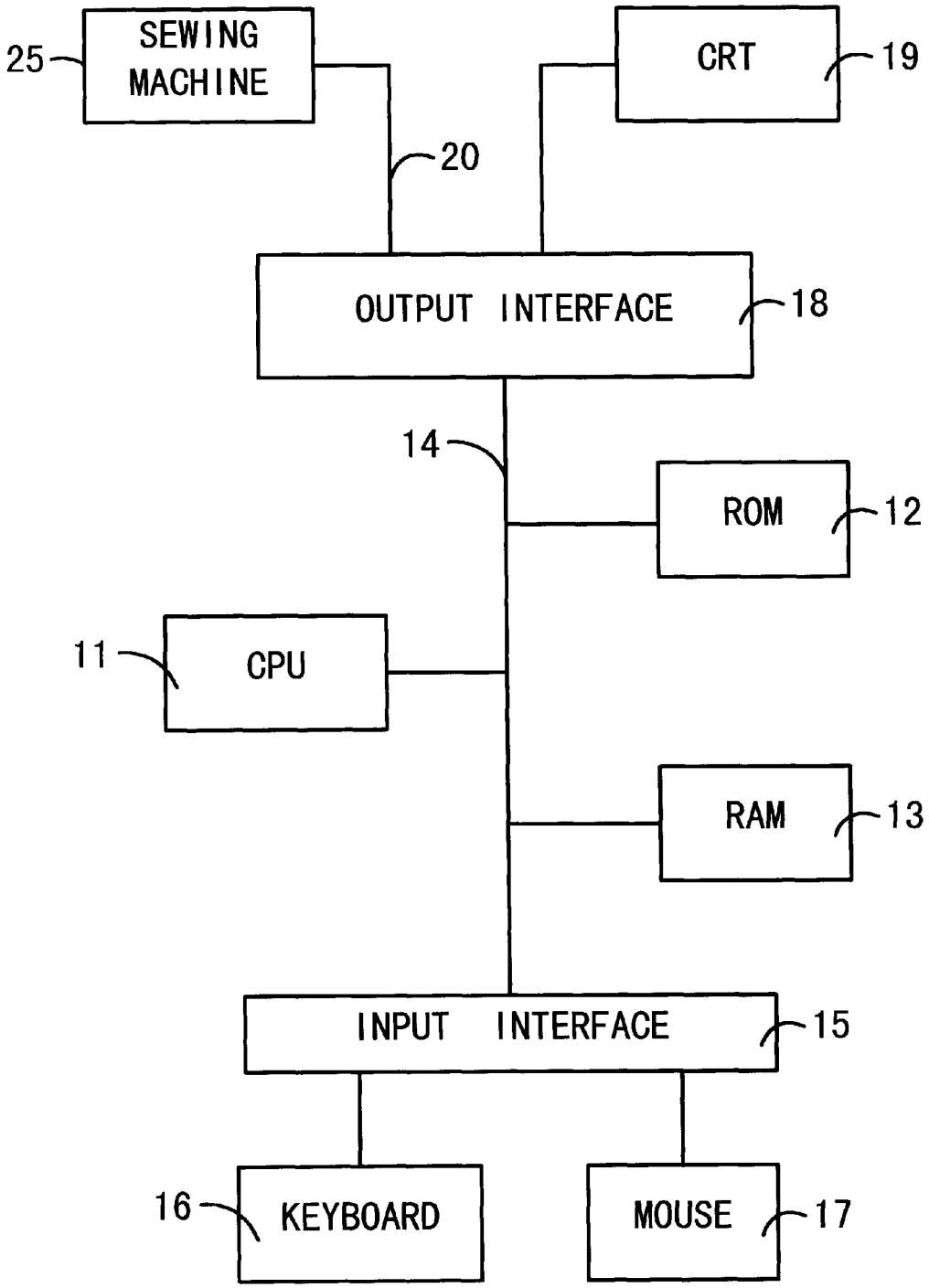
FIG. 2 is a block diagram illustrating the electrical arrangement of the embroidery data processing apparatus of the embodiment of the invention.

FIG. 2 illustrates the electrical arrangement of the embroidery data processing apparatus of the embodiment. The apparatus includes a central processing unit (CPU) 11, a read-only memory (ROM) 12, a random-access memory (RAM) 13, an input interface 15 and an output interface 18 which are interconnected by a bus 14. The CPU 11 controls the entire embroidery data processing apparatus while transmitting and receiving various data and signals. The ROM 12 stores programs and data for control of the embroidery data processing apparatus. The RAM 13 erasably stores data to be inputted from a keyboard 16 (FIGS. 1 and 2) or an external storage device (not shown).

The embroidery data processing apparatus (FIGS. 1 and 2) is equipped with a cathode-ray tube (CRT) display 19 connected to the output interface 18. The CRT display 19 displays various graphics indicating the shapes of embroidery patterns, various messages, and the like.

The keyboard 16 and a mouse 17 are connected to the CPU 11, via the input interface 15. The keyboard 16 has an arrangement of operating keys for a user to input instructions, such as selection of an operation, execution of an operation, and the like. The mouse 17 is a pointing device for, for example, producing or selecting an outline that defines an embroidery shape on the CRT display 19.

The communication cable 20 is connected to the embroidery data processing apparatus by the output interface 18. The embroidery data processing apparatus transmits generated embroidery data to the embroidery sewing machine 25 through the communication cable 20.

Figure 5A:
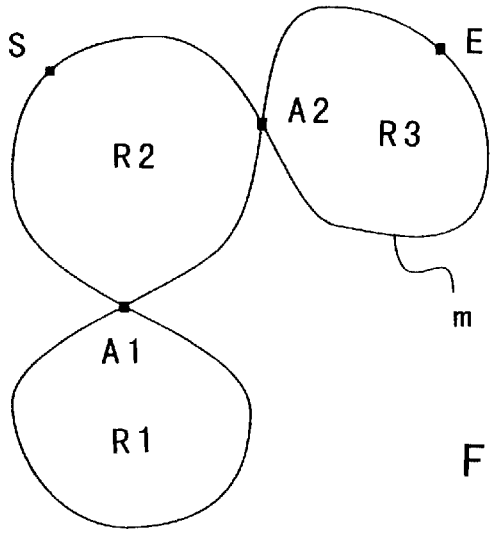
FIGS. 5*a*–5*c* are views explaining a method of producing sewing data in the embroidery data processing apparatus of the embodiment.

Referring next to FIGS. 3, 4, 12, 13, 14 and 15, the operations of the embroidery data processing apparatus of the invention structured as described above will be described. In the embodiment, underlying stitch data and embroidery stitch data are produced for areas that are defined by an outline m shown in FIGS. 5*a*–5*c*. The outline m has a stitching start point S and a stitching end point E which are set in advance by the user to respective positions as shown in FIG. 5*a*.

Figure 11:
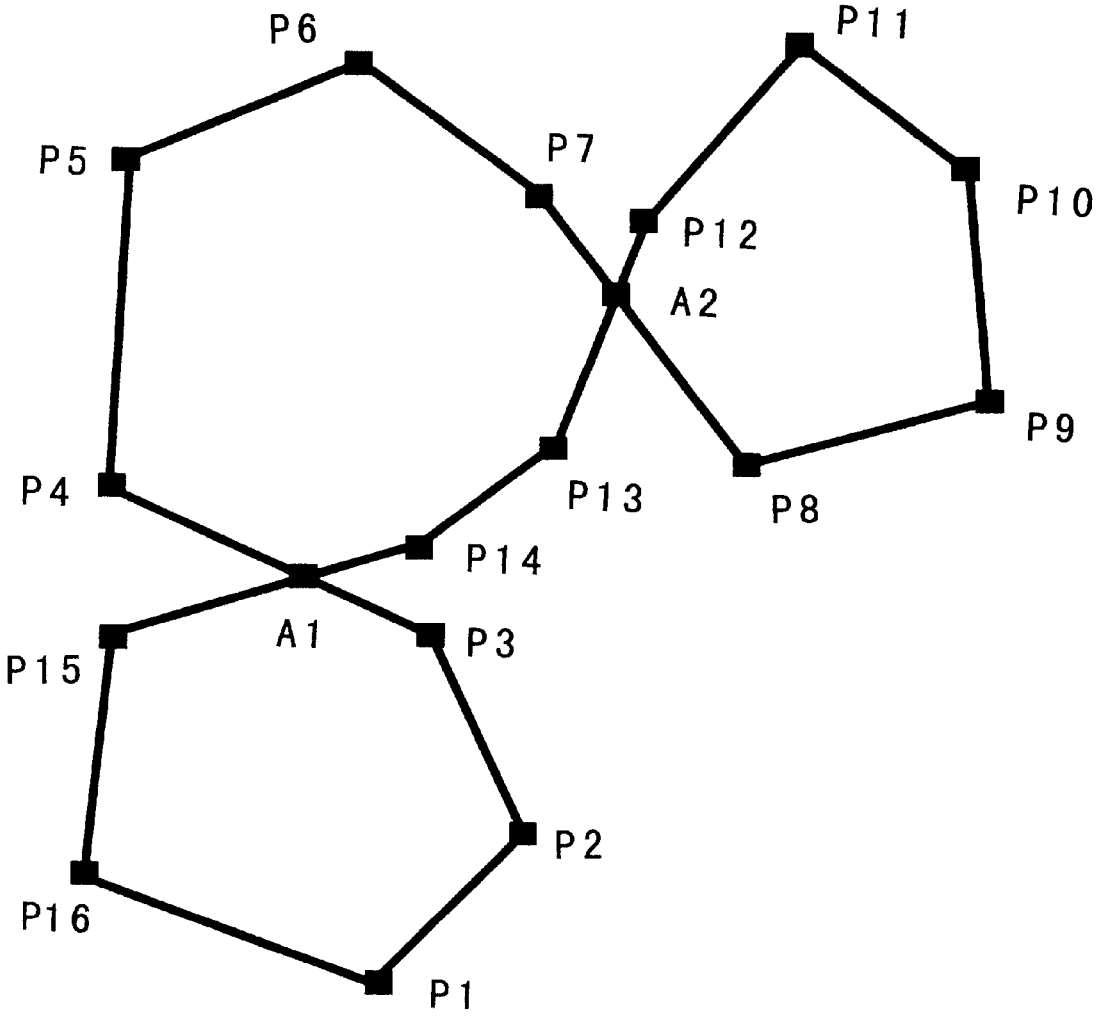
FIG. 11 is a view schematically showing sewing data produced by the embroidery data processing apparatus of the embodiment.
Figure 12:
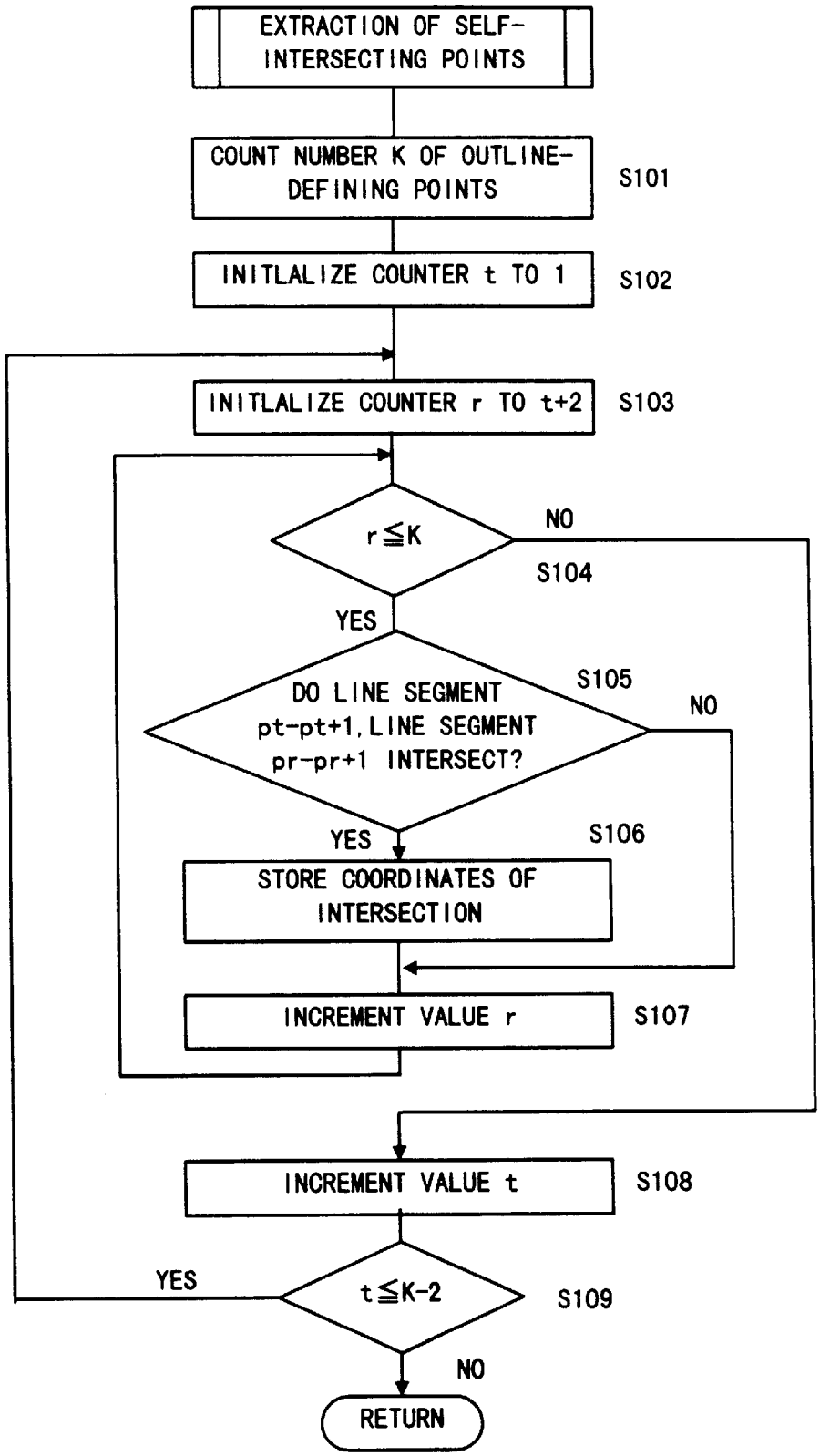
FIG. 12 is a flowchart showing details of step S1 of the flow chart shown in FIG. 3.

Once a program stored in the ROM 12, for producing embroidery data, is started, the directions of stitches are set by the user in step S01 and the stitching start point S and stitching end point E are set by the user in step S02. Then, step S1 is executed to extract a self-intersecting point or points of the outline m. In the example shown in FIG. 5*a*, two self-intersecting points A1, A2 are extracted. The processing for extracting the self-intersecting points in step S1 will be described in detail with reference to the flow chart of FIG. 12. It is assumed that the outline m shown in FIG. 5*a* is a bent outline, as shown in FIG. 11, formed by serially connecting outline-defining points P1–P16.

In step S101, the number K of points defining the outline L is counted. In the example shown in FIG. 11, the number K equals 16.

In step S102, a counter t is initialized to 1.

In step S103, a counter r is initialized to t+2 (that is, 3 in this case).

In step S104, it is determined whether the value of the counter r is equal to or less than the number K of the outline-defining points. Since the value r is presently 3 and the number K is presently 16, the determination in step S104 is YES, and the operation proceeds to step S105.

In step S105, it is determined whether a line segment of pt to pt+1 and a line segment of pr to pr+1 intersect each other. In the present stage, it is determined whether the line segment of P1 to P2 and the line segment of P3 to P4 intersect. Because the line segment of P1–P2 and the line segment of P3–P4 do not intersect, as can be seen in FIG. 11, the determination in step S105 is NO, and the operation jumps to step S107.

In step S107, the value of the counter r is incremented (r=4). The operation subsequently returns to step S104. Similar processing is repeated until the value of the counter r exceeds the number K (=16) of the outline-defining points. When it is determined in step S104 that the counter value r has exceeded the number K (NO in step S104), the operation proceeds to step S108.

In step S108, the value of the counter t is incremented (t=2).

Subsequently, in step S109, it is determined whether the value of the counter t is equal to or less than the value obtained by subtracting 2 from the number K of the outline-defining points. Since the value t presently equals 2 and the value (K−2) presently equals 14, the determination in step S109 is YES, and the operation returns to step S103.

The processing continues until the value of the counter t equals 3 and the value of the counter r equals 14. Since the line segment P3–P4 and the line segment P14–P15 intersect, the determination in step S105 is YES, and the operation proceeds to step S106.

In step S106, the coordinates of the intersecting point between the line segment P3–P4 and the line segment P14–P15 are determined, and stored into the RAM 13. That is, the coordinates of the self-intersecting point A1 of the outline m shown in FIG. 5*a* or FIG. 11 are extracted. The operation then proceeds to step S107.

When the value of the counter t equals 7 and the value of the counter r equals 12 after further processing as described above, the determination in step S105 is YES since the line segment P7–P8 and the line segment P12–P13 intersect. The operation then proceeds to step S106.

In step S106, the coordinates of the intersecting point between the line segment P7–P8 and the line segment P12–P13 are determined, and stored into the RAM 13. That is, the coordinates of the self-intersecting point A2 of the outline m shown in FIG. 5*a* or FIG. 11 are extracted. The operation then proceeds to step S107.

Similar processing is repeated until the value of the counter t becomes equal to 15. Since the value t (=15) is not equal to nor smaller than the value K−2 (14), the determination in step S109 is NO.

It is to be noted that when r=k, then pt+1 would be undefined, i.e., non-existent point P17 in this example. Thus, the routine uses P1, which is the next point on the outline as pt+1.

Figure 3:
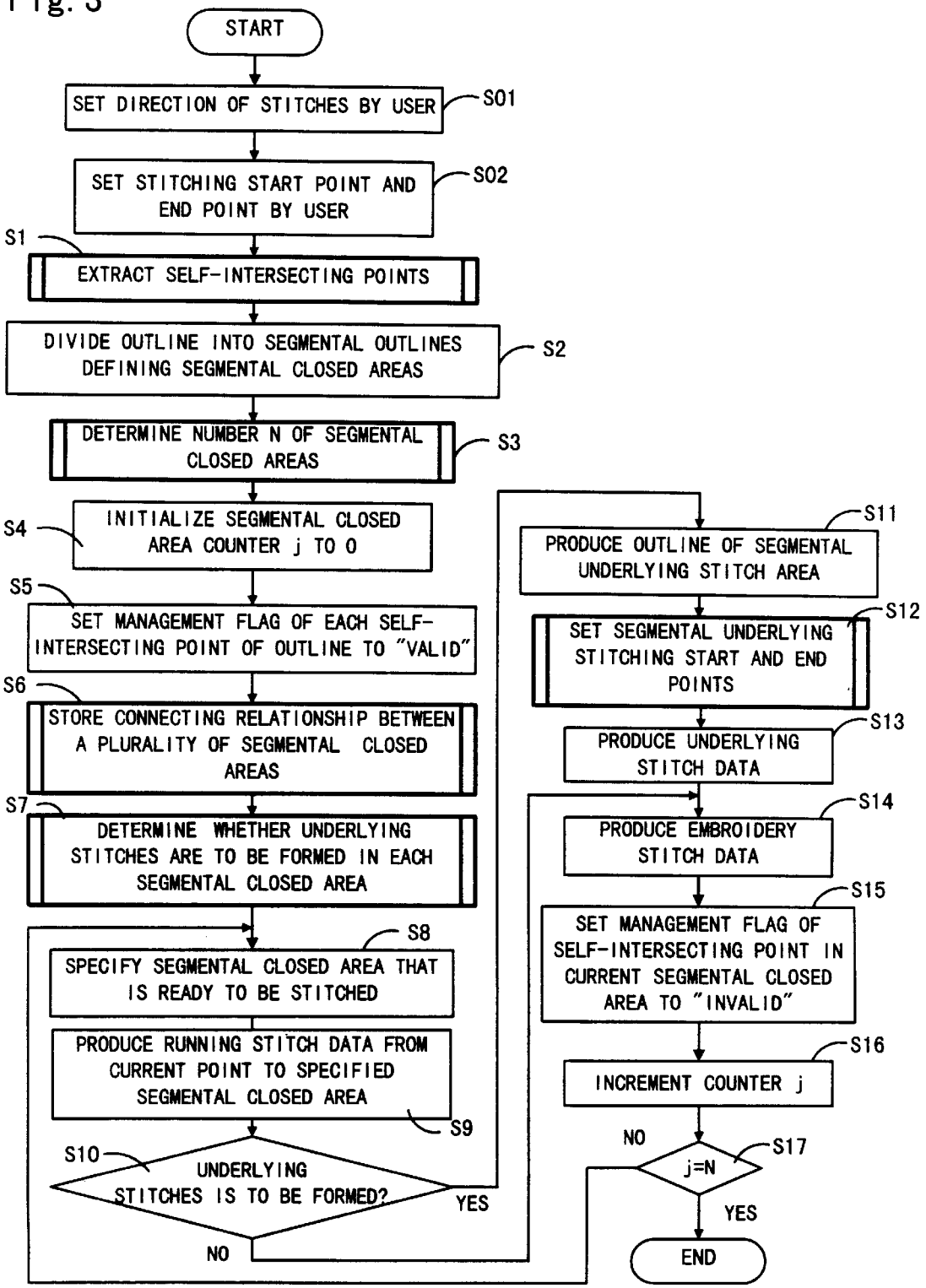
FIG. 3 is a flowchart illustrating an example of the sewing data producing operation performed by the embroidery data processing apparatus of the embodiment.
Figure 4:
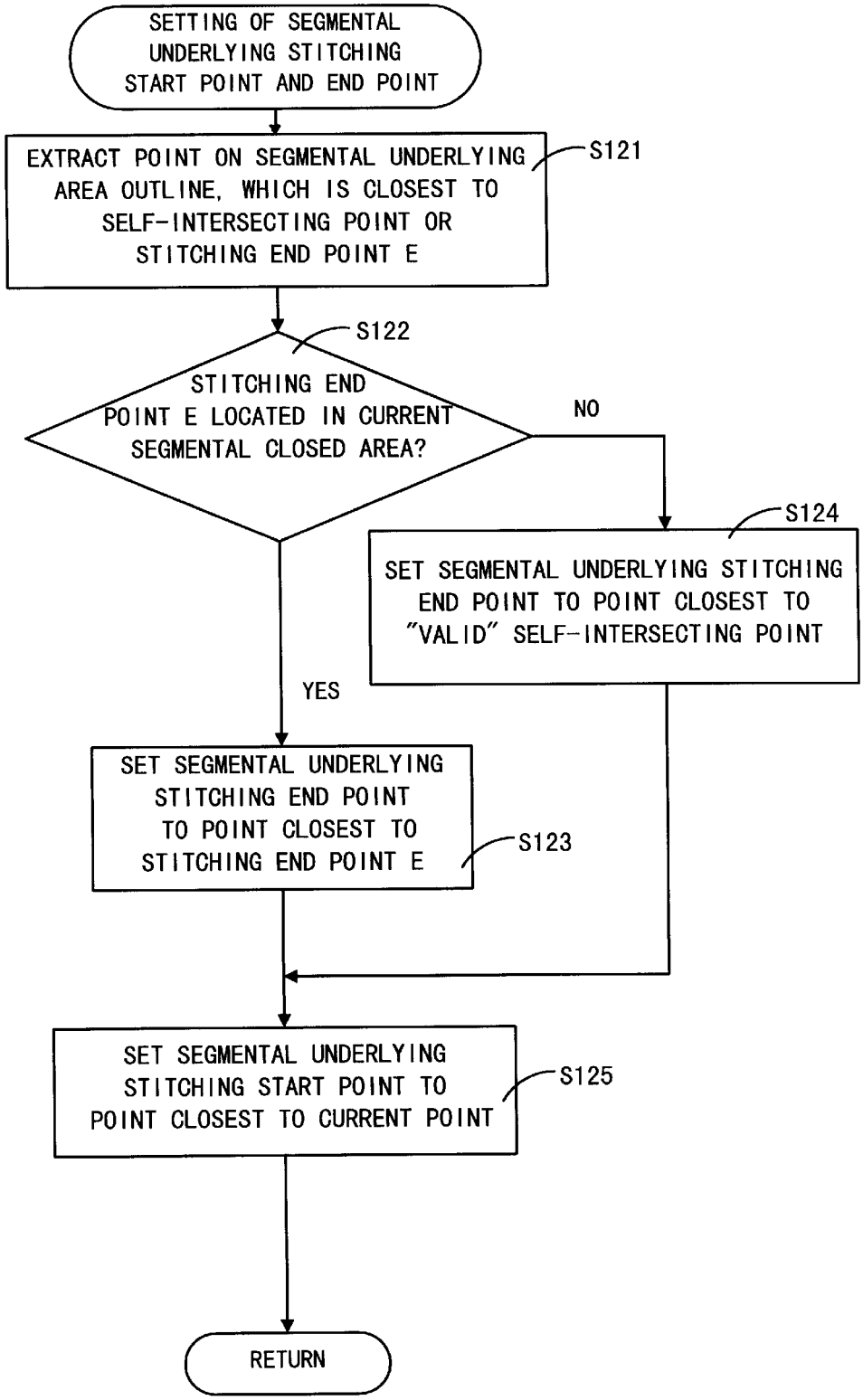
FIG. 4 is a flowchart illustrating details of a part of the sewing data producing operation of FIG. 3 performed by the embroidery data processing apparatus of the embodiment.

The processing for extracting the self-intersecting points of the outline m is completed by executing step S101 through step S109 as described above, and the flow of control goes to step S2 in FIG. 3.

In step S2, the outline m is divided at the self-intersecting points extracted in step S1 into a plurality of segmental outlines, and segmental closed areas that are defined by the respective segmental outlines are established. Namely, in the present embodiment, three segmental closed areas R1, R2, R3 are defined by three segmental outlines into which the outline m is divided at two self-intersecting points A1, A2.

Step S3 is then executed to determine the number N of the segmental closed areas established in step S2. In this example, the value of N is 3.

Figure 5B:
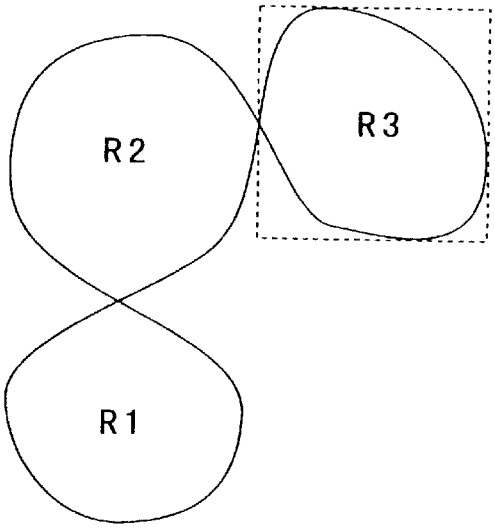
Figure 5C:
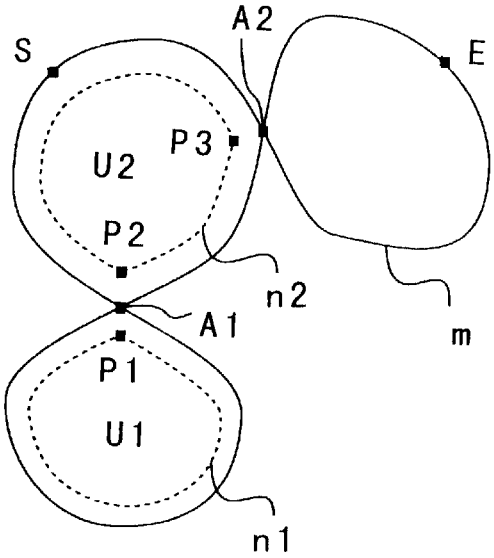

The operation (step S3) of determining the number N of the segmental closed areas will be described in detail with reference to the flowchart of FIG. 13. In this connection, it is assumed that the outline m shown in FIGS. 5*a*–5*c* is made up of a polygonal line that is formed by serially connecting a plurality of outline-defining points P1 to P16, as shown in FIG. 11.

Figure 13:
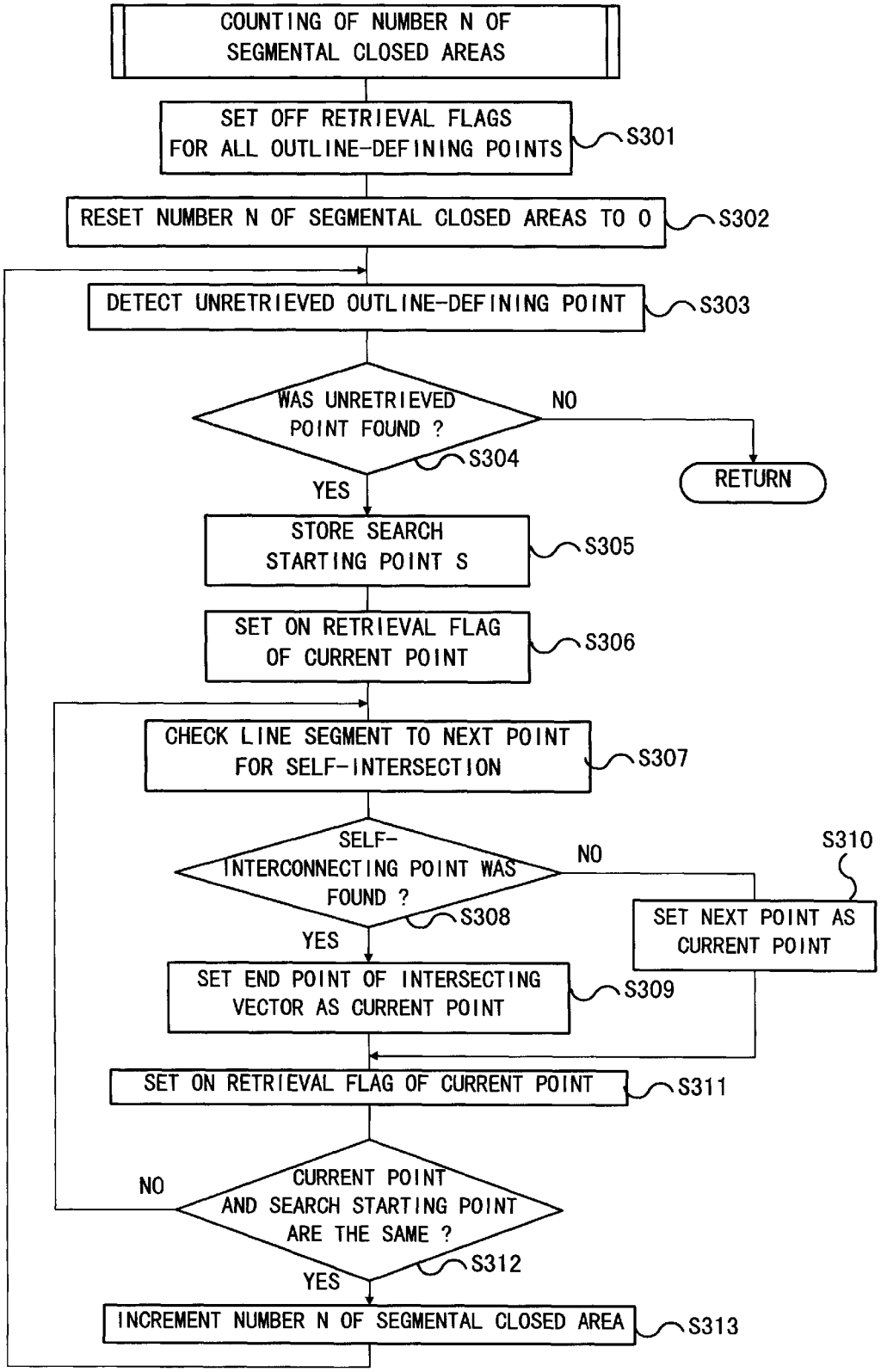
FIG. 13 is a flowchart showing details of step S3 of the flowchart shown in FIG. 3.

In step S301 of the flow chart of FIG. 13 showing the operation of counting the number N of the segmental closed areas, flags indicating retrieval of the individual points defining the outline L for self-intersection search are set to "OFF" (indicating unretrieved). A flag is set to "ON" when the corresponding outline-defining point is retrieved for self-intersection search in a later stage of the operation.

In step S302, the number N of segmental closed areas is reset to 0.

In step S303, an unretrieved outline-defining point, that is, a point that has not been retrieved for self-intersection search, is searched for. Specifically, an outline-defining point with the corresponding flag being "OFF" is searched for, by serially checking the retrieval flags in the sequence of the flags of the points P1 toward P16. In the present stage, the point P1 is first detected as an unretrieved outline-defining point.

In step S304, it is determined whether an unretrieved outline-defining point has been found in step S303. Because the point P1 was found as an unretrieved point and therefore extracted in step S303 in the present stage, the determination in step S304 is YES, and the operation proceeds to step S305.

In step S305, the outline-defining point retrieved in step S303 is stored in the RAM 13 as a search starting point S for the purpose of counting the number of segmental closed areas. In the present stage, the point P1 is stored in the RAM 13 as a search starting point. The point P1 is treated as a current point for self-intersection search.

In step S306, the retrieval flag of the point P1, which is the current point, is set to "ON" (indicating retrieved).

In step S307, the line segment from the current point P1 to the next point P2 is checked for the presence of a self-intersecting point of the outline m.

In step S308, it is determined whether a self-intersecting point of the outline m was found in the line segment presently concerned in step S307. In the present stage, the determination in step S308 is NO because the line segment P1–P2 does not have a self-intersecting point of the outline m as shown in FIG. 11. The operation then goes to step S310.

In step S310, the point P2, which has been used as the next point, is set as a current point.

In step S311, the retrieval flag of the current point, that is, the point P2, is set to "ON" (indicating retrieved).

In step S312, it is determined whether the current point and the search starting point S are one and the same point. As the current point P2 for the search and the search starting point P1 are not the same, the determination in step S312 is NO, and the operation returns to step S307.

Similar processing continues until the current and next points for search become the point P3 and the point P4, respectively. In step S307, the line segment P3–P4 is checked for the presence of a self-intersecting point of the outline m. Because the line segment P3–P4 has a self-intersecting point A1 of the outline m as shown in FIG. 11, the presence of the self-intersecting point A1 is confirmed in step S307. The determination in step S308 therefore is YES, and the operation proceeds to step S309.

In step S309, the end point of the vector (line segment) intersecting with the presently-concerned line segment at the self-intersecting point of the outline m is set as a current point. In the present stage, the end point P15 of the vector P14–P15 intersecting with the concerned line segment P3–P4 is set as a current point for the next search for an self-intersecting point. The decision rule used in such a case is that the highest numbered point is selected.

In step S311, the retrieval flag of the current point P15 for search is set to "ON".

Because the current point P15 and the search starting point P1 are not the same, the determination in step S312 is NO, and the operation returns to step S307.

Similar processing continues until step S310 sets the point P1 as a current point for search, which occurs after the current and next points for search have been set to the point P16 and the point P1. In step S312, it is determined that the current point P1 for search and the search starting point P1 are the same point. The operation then proceeds to step S313.

In step S313, the number N of segmental closed areas (N=0) is incremented (to N=1). The operation then returns to step S303.

In step S303, an unretrieved outline-defining point is searched for. In the present stage, the point P4 is detected and extracted as an unretrieved point because the point P4 is the first point with the corresponding retrieval flag being "OFF" that is detected by serially checking the retrieval flags of outline-defining points in the sequence of the flags of points P1 toward P16.

In step S305, the point P4 is set as a search starting point.

Similar processing continues until the current and next points for search become the point P7 and the point P8, respectively. Since the line segment P7–P8 has a self-intersecting point A2 of the outline m as shown in FIG. 11, the presence of the self-intersecting point A2 on the line segment P7–P8 is confirmed in step S307. The determination in step S308 therefore is YES, and the operation proceeds to step S309.

In step S309, the end point P13 of the vector P12–P13 intersecting the line segment P7–P8 is set as a new current point using the decision rule. The subsequent operation is continued.

Similar processing continues until the current and next points for search become the point P14 and the point P15, respectively. Since the line segment P14–P15 has the self-intersecting point A1 of the outline m as shown in FIG. 11, the presence of the self-intersecting point A1 on the line segment P14–P15 is confirmed in step S307. The determination in step S308 therefore is YES, and the operation proceeds to step S309.

In step S309, the end point P4 of the vector P3–P4 intersecting the line segment P14–P15 is set as a new current point using the decision rule.

In step S312, it is determined that the current point P4 and the search starting point P4 are the same point. The operation then proceeds to step S313.

In step S313, the number N of segmental closed areas (N=1) is incremented (to N=2). The operation then returns to step S303.

In step S303, an unretrieved outline-defining point is searched for. In the present stage, the point P8 is detected and extracted as an unretrieved point because the point P8 is the first point with the corresponding retrieval flag being "OFF" that is detected by serially checking the retrieval flags of outline-defining points in the sequence of the flags of points P1 toward P16.

In step S305, the point P8 is set as a search starting point.

Processing similar to that described above continues until the current and next points for search become the point P12 and the point P13, respectively. In step S307, it is confirmed that the self-intersecting point A2 of the outline m is present on the line segment P12–P13. Therefore, the determination in step S308 is YES.

In step S309, the end point P8 of the vector P7–P8 intersecting the line segment P12–P13 is set as a new current point using the decision rule.

After the retrieval flag of the current point P8 is set to "ON" in step S311, it is determined in step S312 that the current point P8 and the search starting point P8 are the same point, and the operation proceeds to step S313.

In step S313, the number N of segmental closed areas (N=2) is incremented (to N=3). The operation then returns to step S303.

Since the retrieval flags of all the outline-defining points P1–P16 have been set to "ON", an unretrieved outline-defining point cannot be detected in step S303. Therefore, the determination in step S304 is NO, and the operation goes to step S4 in FIG. 3.

The number N (=3) of segmental closed areas is thus counted by the operation of steps S301 to S313.

In step S4 of the flow chart shown in FIG. 3, the value of a segmental closed area counter j is initialized to 0.

In the next step S5, a management flag for each of the self-intersecting points A1, A2 of the outline m extracted in step S1 is set to "valid". Reference will be made to this management flag in a routine for determining the sewing order, and a routine for determining segmental underlying stitching start and end points as described later.

Figure 9A:
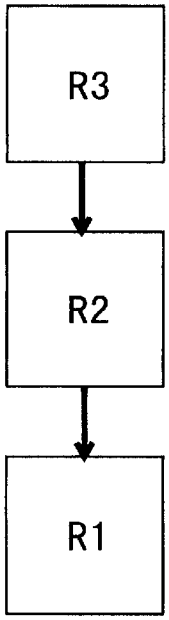
FIGS. 9*a*–9*b* are views explaining connecting relationship storing means of the embroidery data processing apparatus of the embodiment.
Figure 9B:
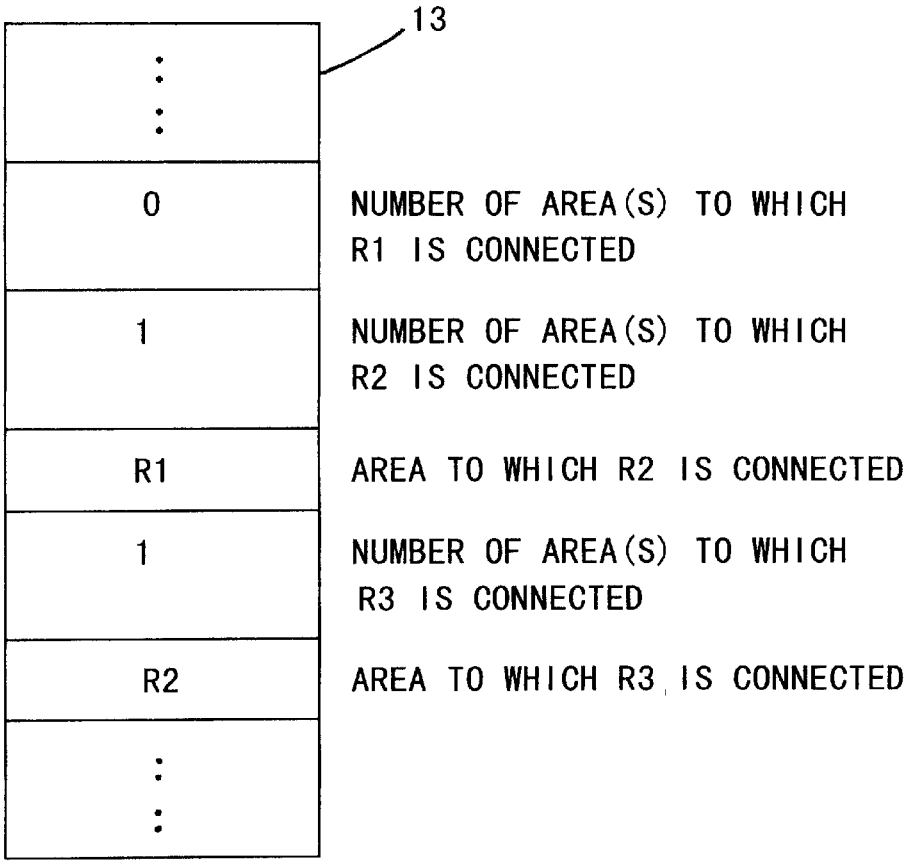
Figure 10:
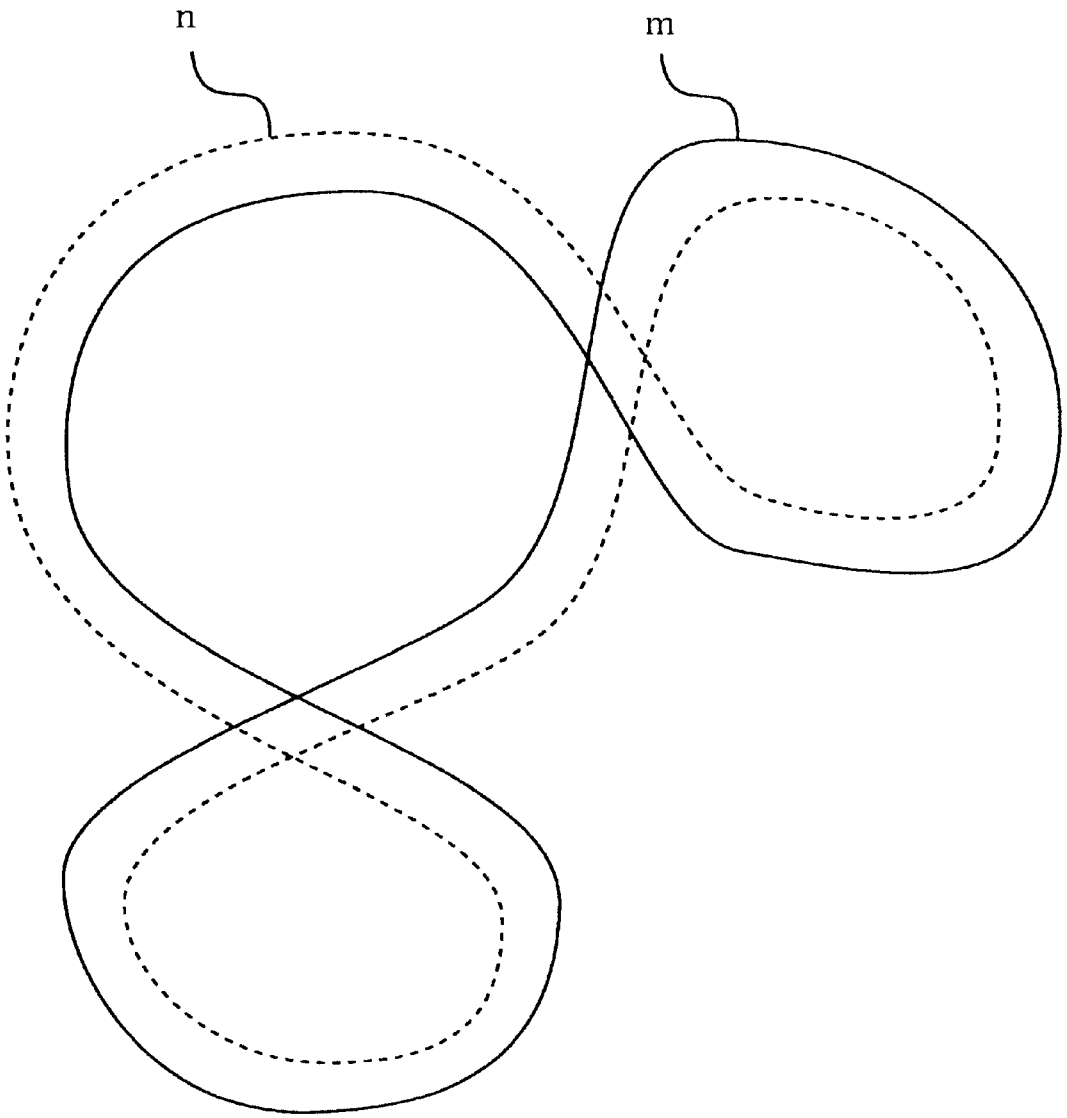
Fig. 10 Related Art
FIG. 10 is a view explaining a problem in a method of producing sewing data for performing underlying stitching in a known embroidery data processing apparatus.

Step 6 is then executed to store a connecting relationship among the segmental closed areas. More specifically, the connecting relationship among the segmental closed areas is established in a hierarchical structure in which the segmental closed area having the stitching end point is placed at the top of the hierarchy, and this relationship is stored in RAM 13. In this embodiment, the hierarchical structure is established wherein the segmental closed area R3 having the stitching end point is placed at the top of the structure, and the segmental closed area R2 connected to the area R3 is placed in the second stage, while the segmental closed area R1 connected to the area R2 is placed in the third stage, as shown in FIG. 9*a*. This connecting relationship is stored at certain addresses in the RAM 13, as shown in FIG. 9*b*. Namely, the RAM 13 stores, for each segmental closed area, the number of segmental closed areas to which the segmental closed area in question is connected, and the name (R1, R2, for example) of the areas to which the segmental closed area in question is connected, as shown in FIG. 9*b*.

Figure 14:
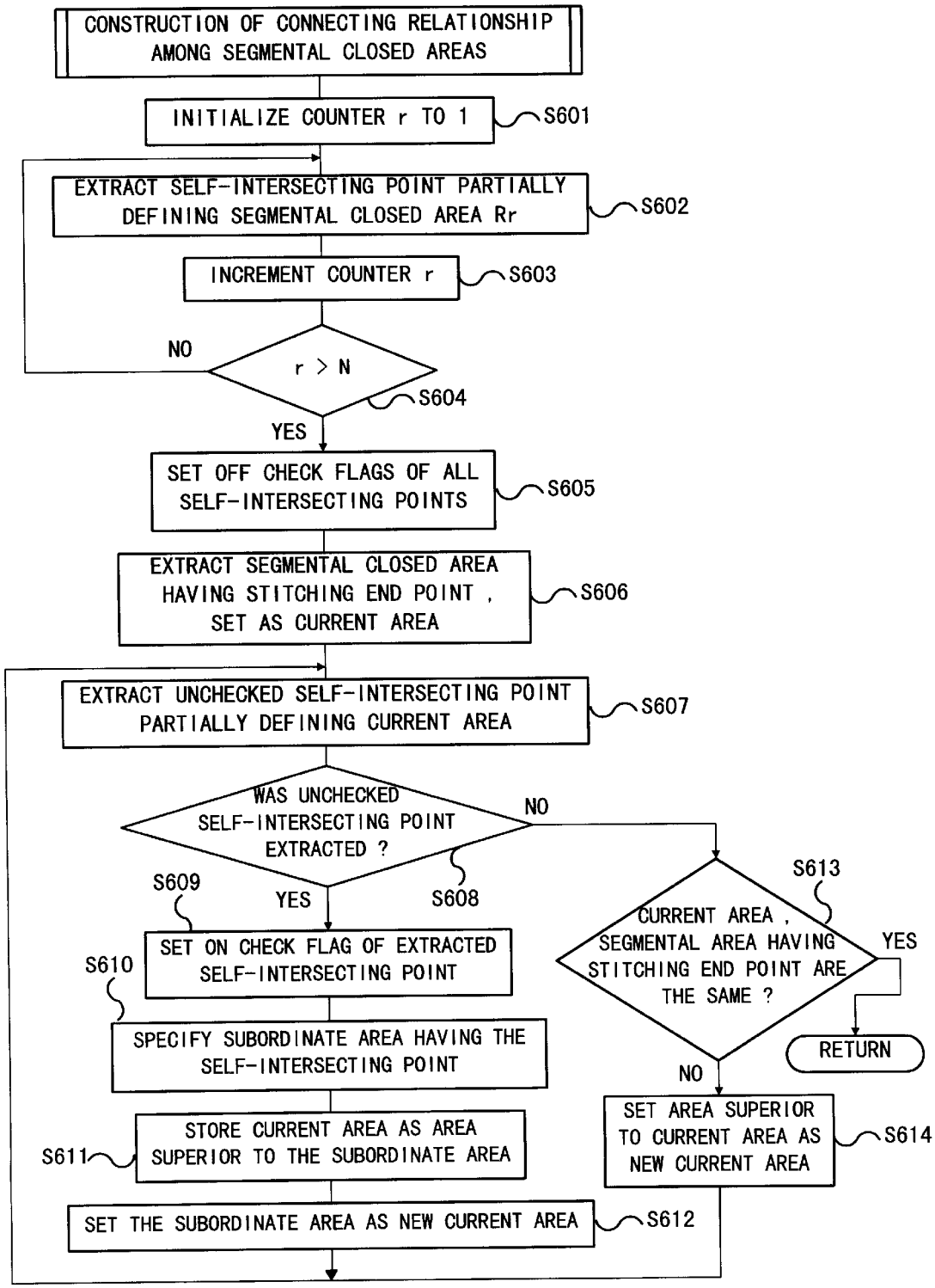
FIG. 14 is a flowchart showing details of step S6 of the flowchart shown in FIG. 3.

The operation of step S6 will be described in detail with reference to the flowchart of FIG. 14.

In step S601, the value of a counter r is initialized to 1.

In step S602, an outline self-intersecting point on a segmental outline enclosing a segmental closed area Rr is extracted. In the present stage, the self-intersecting point A1 on a segmental outline enclosing a segmental closed area R1 is extracted.

In step S603, the value of the counter r (=1) is incremented (to r=2).

In step S604, it is determined whether the value of the counter r (=1) is greater than the number N (=3) of segmental closed areas. At this point, the determination in step S603 is NO, and the operation returns to step S602.

In a similar manner, A1 and A2 are extracted as self-intersecting points on the outline m that defines the segmental closed area R2, and A2 is extracted as a self-intersecting point on the outline m that defines the segmental closed area R3. In step S603, the value (=3) of the counter r is incremented (r=4).

In step S604, it is determined that the value (=4) of the counter r is greater than the number N (=3) of the segmental closed areas, and the control flow proceeds to step S605.

In step S605, flags indicating that the respective self-intersecting points of the outline m have been checked are set to OFF.

In step S606, the segmental closed area having the stitching end point is extracted. In this example, the segmental closed area R3 having the stitching end point E is extracted and set as a current area. Step S607 is then executed to extract any self-intersecting point of the current area that has not been checked. In this example, the self-intersecting point A2 of the current area R3 is extracted since this point A2 has not been checked.

Step S608 determines whether the self-intersecting point that has not been checked could be extracted in the previous step S607. Since the self-intersecting point A2 was extracted in the previous step S607 in this example, a YES decision is obtained in step S608, and the control flow proceeds to step S609. In step S609, the flag of the self-intersecting point A2 thus extracted is set to "ON".

In step S610, another segmental closed area having the same self-intersecting point A2, other than the current area, is specified as a subordinate area of the current area. In this example, the segmental closed area R2 is extracted as another segmental closed area having the self-intersecting point A2, and specified as a subordinate area of the segmental closed area R3 as the current area.

In step S611, the current area is set as a superior area of the segmental closed area that was specified as the subordinate area of the current area. Namely, in this example, the segmental closed area R3 is set as a superior area of the segmental closed area R2, and this relationship is stored in RAM 13.

In step S612, the segmental closed area that was specified as the subordinate area of the current area is set as a new current area. Namely, in the present example, the segmental closed area R2 becomes the new current area. The control flow then returns to step S607.

In step S607, the flags of the self-intersecting points A1, A2 of the outline m that define the current area R2 are checked, and the self-intersecting point A1 whose flag is "OFF" that indicates that the point A2 has not been checked is extracted.

In step S608, a YES decision is obtained since the self-intersecting point A1 was extracted in the previous step S607. The control flow then goes to step S609.

In step S609, the check flag of the extracted self-intersecting point A1 is set to "ON".

In step S610, the segmental closed area R1 is extracted as another segmental closed area having the self-intersecting point A1, and specified as a subordinate area of the segmental closed area R2 as the current area. In step S611, the segmental closed area R2 is set as a superior area of the segmental closed area R1, and this relationship is stored in RAM 13. In step S612, the segmental closed area R1 is set as a new current area. The control flow then returns to step S607.

In step S607, any self-intersecting point of the current area R1 that has not been checked is extracted, but no such point can be extracted since all of the self-intersecting points have been checked at this point in the current cycle.

Since no self-intersecting point that has not been checked was extracted in the previous step S607, a NO decision is obtained in step S608, and the control flow proceeds to step S613.

Step S613 determines whether the current area is the same as the segmental closed area having the stitching end point. In this example, a NO decision is obtained in step S613 since the current area R1 is not the same as the segmental closed area R3 having the stitching end point, and the control flow proceeds to step S614.

In step S614, the segmental closed area that has been set as the superior area of the current area is set as a new current area. In this example, the segmental closed area R2 defined as the superior area of the current area R1 is set as a new current area. The control flow then returns to step S607.

After similar processing is performed in step S607 and step S608, step S613 determines that the current area R2 is not the same as the segmental closed area R3 having the stitching end point. In step S614, the segmental closed area R3 that has been set as the superior area of the current area R2 is set as a new current area, and the control flow returns to step S607.

After steps S607 and S608 are executed in a similar manner, step S613 finally determines that the current area R3 is the same as the segmental closed area R3 having the stitching end point, and the control flow goes to step S7 of FIG. 3.

By performing the operation of step S601 through step S614 as described above, the connecting relationship among the segmental closed areas as shown in FIG. 9*a* is established.

In step S7 of the flow chart shown in FIG. 3, the CPU 11 receive a setting for each segmental closed area as to whether underlying stitches are to be formed in the area. If it is assumed in the initial setting that underlying stitches are to be formed in all of the segmental closed areas, step S7 enables the user to select a certain segmental closed area or areas so that the underlying stitches will not be formed in the selected areas. More specifically, the user may point to the segmental closed area R3, for example, with a pointer of a mouse 17, out of the segmental closed areas that are displayed on a part of a screen of the CRT display 19, and press a button of the mouse 17 to select the segmental closed area R3. FIG. 5*b* shows a part of the screen of the CRT display 19 that appears when the segmental closed area R3 is selected. In the display of FIG. 5*b*, the smallest rectangle that can surround the selected segmental closed area R3 is indicated by a broken line.

Figure 6:
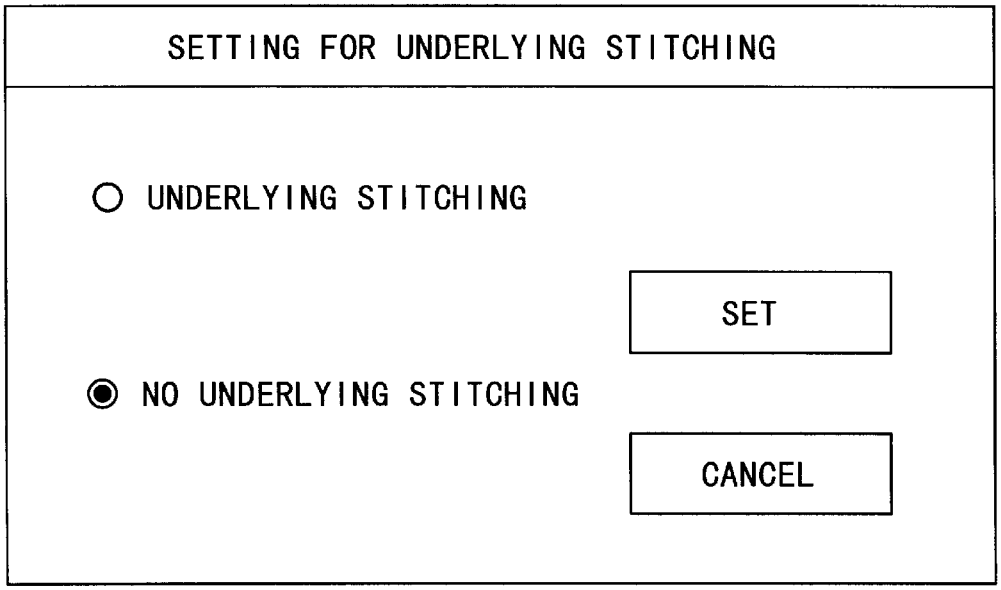
FIG. 6 is a view showing one example of underlying stitching setting means of the embroidery data processing apparatus of the embodiment.
Figure 7:
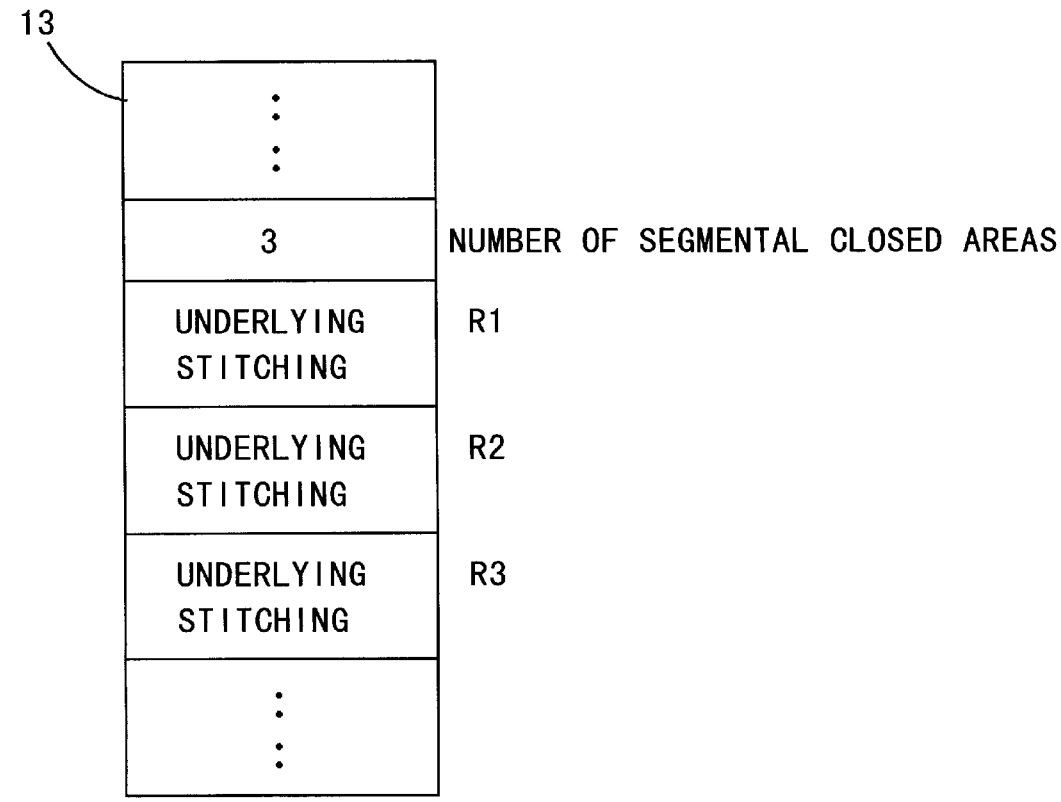
FIG. 7 is a view explaining underlying stitching set value storing means of the embroidery data processing apparatus of the embodiment.

Subsequently, the user sets the selected segmental closed area R3 to a value that indicates that underlying stitches are not to be formed in this area, in a dialog box displayed in another part of the CRT display 19 for setting of underlying stitching as shown in FIG. 6. In this connection, it is possible for the user to change the value that has been set for each segmental closed area as to whether underlying stitching is to be performed in the area, by selecting the segmental closed area again by the operating method as described above. Then, in the step S7, the set value for each segmental closed area as to whether underlying stitching is to be performed is stored in RAM 13, based on the setting operation by the user. FIG. 7 shows data that is stored in RAM 13 in this step. As shown in FIG. 7, the total number of segmental closed areas is initially stored at a predetermined address, and then the set value with regard to underlying stitching in each segmental closed area is stored one after another.

Figure 15:
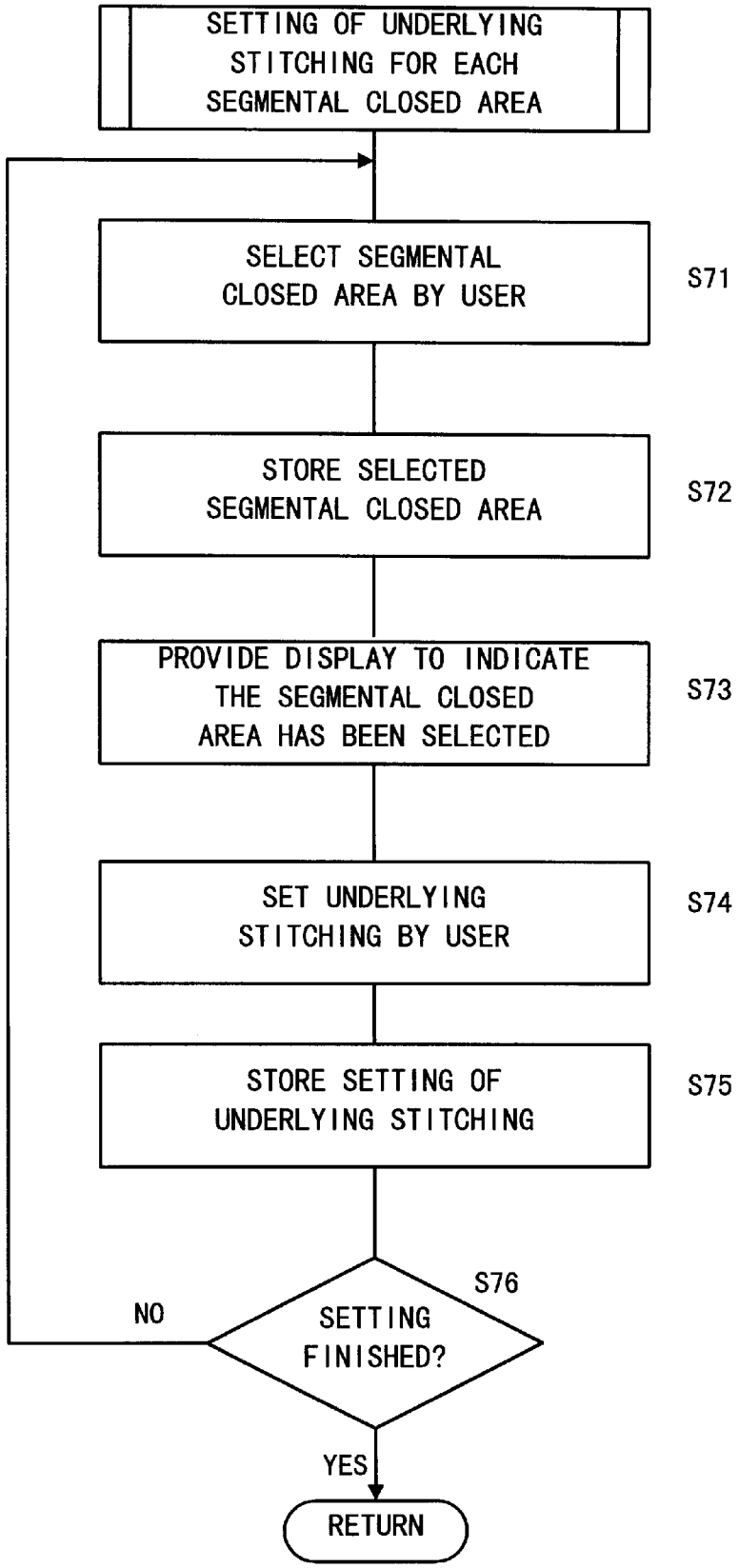
FIG. 15 is a flowchart showing details of step S7 of the flowchart shown in FIG. 3.

The operation in the above-described step S7 will be described in detail with reference to the flowchart of FIG. 15.

In step S71, the CPU 11 receives a segmental closed area that has been selected by the user. Step S72 is then executed to store the selected segmental closed area. In this example, the segmental closed area R3 is stored in the RAM 13 as the selected area.

In step S73, a display as shown in FIG. 5*b* is provided to indicate that the segmental closed area R3 has been selected.

In step S74, the CPU 11 receives a setting by the user with regard to underlying stitching. In this step, the user sets the selected segmental closed area to one of two values indicating whether underlying stitching is to be performed, using the dialog box shown in FIG. 6.

In step S75, the value set in the above step S74 with regard to underlying stitching is stored in RAM 13. In this example, the RAM 13 stores the set value that indicates that underlying stitching is not to be performed in the segmental closed area R3.

Step S76 determines whether the user wishes to continue the setting operation. If the user selects another segmental closed area, or changes the setting for underlying stitching, a NO decision is obtained in step S76, and the control flow returns to step S71. If the user finishes the setting operation, a YES decision is obtained in step S76, and the control flow proceeds to step S8 in FIG. 3.

In the operation of steps S71 through S76 as described above, the user can set whether underlying stitching is to be performed in the area for each segmental closed area.

In step S8 of the flow chart shown in FIG. 3, a segmental closed area that is ready to be stitched is specified. More specifically, a segmental closed area that has only one "valid" self-intersecting point of the outline m is specified, where the stitching end point E is also regarded as a provisional "valid" self-intersecting point. Namely, in this example, the segmental closed area R1 has one self-intersecting point A1, and the area R2 has two self-intersecting points A1, A2, while the area R3 has one self-intersecting point A2 and the stitching end point E. Accordingly, the segmental closed area R1 is specified as a segmental closed area that is ready to be initially stitched. Although a plurality of segmental closed areas may be judged as segmental closed areas that are ready to be stitched, depending upon the value of the total number N of the segmental closed areas or the position of the stitching end point E, any of these segmental closed areas with a single self-intersecting point may be specified. For example, the segmental closed area that is judged at first as being ready to be stitched may be specified as the area that is to be initially stitched.

In step S9, running stitch data is produced as auxiliary sewing data for forming running stitches from the stitching start point as the current sewing point to the segmental closed area specified as being ready to be stitched in step S8. In this example, the switching start point S is located on the segmental outline defining the segmental closed area R2, and the segmental closed area R2 is connected to the specified segmental closed area R1 according to the relationship among the segmental closed areas stored in step S6. In this step, therefore, running stitch data is produced for forming running stitches from the stitching start point S to the self-intersecting point A1 of the outline m that is a connecting point between the segmental closed areas R1, R2, such that the stitches pass through the interior of the segmental closed area R2. Then, the current sewing point is updated to the self-intersecting point A1.

In the case where the segmental closed area having the stitching start point is not located adjacent to the segmental closed area specified as being ready to be stitched, the running stitches may be formed through another segmental closed area or areas. In such cases, data representing a path that extends from the segmental closed area having the current sewing point to the intermediate segmental closed area through which the specified area is reached is initially produced. Subsequently, running stitch data is produced for forming running stitches from the current sewing point to the connecting point between the segmental closed area having the current point and the next segmental closed area on the path, through the interior of the segmental closed area having the current point. Then, the connecting point is set as the current sewing point.

The above operation is performed with respect to each segmental closed area on the path, so that continuous running data is produced for forming running stitches from the current sewing point to the segmental closed area specified as being ready to be stitched. The running stitch data may be produced as data representing a certain path that does not stray or depart from each segmental closed area located between the current sewing point and the specified segmental closed area.

In step S10, it is determined whether the segmental closed area R1 that is to be stitched first is set to the value indicating that underlying stitching is to be performed. Since the segmental closed area R1 has been set in step S7 to the value to perform underlying stitching, and this value has been stored in RAM 13, a YES decision is obtained in step S10, and the control flow goes to step S11.

In step S11, an outline of a segmental underlying stitch area is produced for the segmental closed area in which underlying stitches are to be formed. In this example, a segmental underlying stitch area outline n1 may be produced in a similar method to that of the known embroidery data processing apparatus, based on the segmental outline that defines the segmental closed area R1. Thus, a segmental underlying stitch area U1 that is defined by the segmental underlying stitch area outline n1 is established as shown in FIG. 5*c*.

In step S12, underlying stitching start point and underlying stitching end point to be used in an underlying stitching operation are set for the segmental underlying stitch area U1 established in step S11. The operation performed in this step will be described in detail with reference to FIG. 4.

Step 121 is initially executed to extract point P1 on the segmental underlying stitch area outline n1, which point is closest to the self-intersecting point A1 of a portion of the outline m that defines the segmental closed area R1.

In step S122, it is determined whether the stitching end point E is located in the segmental closed area R1 that was specified in step S8 as being ready to be stitched. Since the stitching end point E is not located in the segmental closed area R1, the control flow goes to step S124 in which point P1 on the segmental underlying stitch area outline n1 that was extracted in step S121 is set to a segmental underlying stitching end point for the segmental underlying stitch area U1.

In step S125, the point P1 on the segmental underlying stitch area outline n1 that was extracted in step S121, which is the closest point to the current sewing point, namely, the self-intersecting point A1 of the outline m, is set to the segmental underlying stitching start point for the segmental underlying stitch area U1. In the processing heretofore described, setting of the segmental underlying stitching start point and segmental underlying stitching end point is accomplished, and the control flow goes to step S13 shown in FIG. 3.

Figure 8A:
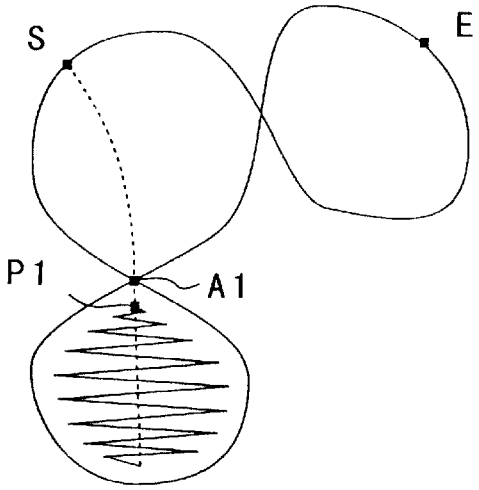
FIGS. 8*a*–8*d* are views schematically showing sewing data produced by the embroidery data processing apparatus of the embodiment.

In step S13, sewing data is produced for performing underlying stitching in the segmental underlying stitch area U1. In this step, underlying stitch data is produced based on the segmental underlying stitching start point and segmental underlying stitching end point that were set in step S12. Initially, running stitch data is produced for forming running stitches that connect the self-intersecting point A1 of the outline m as the current sewing point, and the segmental underlying stitching start point P1 of the segmental underlying stitch area U1. Then, sewing data for forming underlying stitches is produced by a similar method to that of the known embroidery data processing apparatus, with the point P1 being regarded as the segmental underlying stitching start point and segmental underlying stitching end point. In this example, the direction of underlying stitches is set in advance by the user to the lateral direction as viewed in FIGS. 5*a*–5*c* or FIGS. 8*a*–8*d*. FIG. 8*a* schematically shows stitches that have been formed at this point of the control cycle. Then, the current sewing point is updated to P1.

In the next step S14, sewing data is produced so that the interior of the segmental closed area R1 is filled with stitches. In step S14, the segmental stitching starting point and segmental stitching end point for the segmental closed area R1 are initially determined. In the following description, the method for determining the segmental stitching start point and segmental stitching end point for each of the segmental closed areas R1, R2, R3 will be described.

In the example shown in FIG. 5*a*, there are three segmental closed areas R1, R2, R3, and the stitching start point S for the whole closed area is set to lie on the segmental outline that defines the area R2, and the stitching end point E is set to lie on the segmental outline that defines the area R3. The order of sewing the segmental closed areas is determined based on the connecting relationship among these areas, so that stitching is first performed in the area R1, then in the area R2 and finally in the area R3. Accordingly, the self-connecting point A1 as the connecting point between the area R1 to be stitched first and the area R2 to be stitched next is determined to be the stitching end point for the segmental closed area R1 and the stitching start point for the segmental closed area R2. Also, the self-connecting point A2 as the connecting point between the area R2 to be stitched after the area R1 and the area R3 to be finally stitched is determined to be the stitching end point for the segmental closed area R2 and the stitching start point for the segmental closed area R3. Because the stitching start point S for the whole closed area lies on the segmental outline that defines the segmental closed area R2, and the segmental closed area R1 is set to be stitched in the first place, the self-connecting point A1 connecting the areas R2 and R1 is determined to be the segmental stitching start point for the segmental closed area R1. Since the stitching end point E for the whole closed area lies on the segmental outline that defines the segmental closed area R3, the stitching end point E is determined to be the segmental stitching end point for the segmental closed area R3.

Figure 8B:
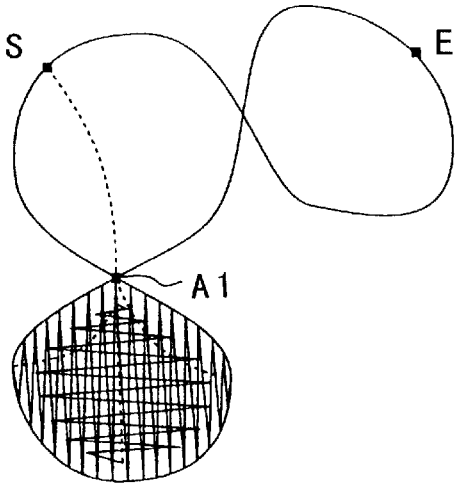

In the manner as described above, in step S14, the segmental stitching start point and segmental stitching end point for the segmental closed area R1 are set to the self-intersection point A1. The direction of stitches is set in advance by the user to the direction perpendicular to the direction of underlying stitches in the segmental underlying stitch area U1, namely, the vertical direction as viewed in FIGS. 5*a*–5*c* or FIGS. 8*a*–8*d* (S01). After producing running stitch data for forming running stitches connecting the current sewing point P1 and the point A1 as the segmental stitching start point of the segmental closed area R1, sewing data for forming embroidery stitches in the interior of the segmental closed area R1 is produced by a method similar to that of the known embroidery data processing apparatus. Such stitching is described in U.S. Pat. No. 5,576,968, the disclosure of which is incorporated by reference herein. Then, the current sewing point is updated to A1. FIG. 8*b* schematically shows stitches that have been formed at this point of the control cycle.

In step S15, the management flag of the self-intersecting point A1 of the outline m that is present in the segmental closed area R1 is set to "invalid".

In step S16, the value of the segmental closed area counter j (=0) is incremented (j=1).

In step S17, it is determined that the value of the segmental closed area counter j (=1) is not equal to the total number N (=3) of the segmental closed areas, and the control flow returns to step S8 as described above.

In step S8, the segmental closed area which is now ready to be stitched is specified. More specifically, the segmental closed area having only one "valid" self-intersecting point of the outline m is specified, where the stitching end point E is also regarded as a provisional "valid" self-intersecting point. Although the segmental closed area R2 has two self-intersecting points A1, A2, only the point A2 is counted as the valid self-intersecting point because the management flag of A1 has been set to "invalid" in step S15 of the last cycle. The area R3 has two self-intersecting points, that is, the point A2 and the stitching end point E. Accordingly, the segmental closed area R2 is specified as being ready to be stitched next.

In step S9, running stitch data is produced as auxiliary sewing data for forming running stitches from the self-intersecting point A1 of the outline m as the current sewing point to the segmental closed area R2 that was specified in step S8 as being ready to be stitched. As the self-intersecting point A1 of the outline m is the current sewing point and is present in the segmental closed area R2 in this example, running stitch data as auxiliary sewing data is not produced as it is unnecessary.

Step S10 is then executed to determine whether the segmental closed area R2 that is to be stitched next is set to the value indicating that underlying stitching is to be performed. Since this segmental closed area R2 has been set in step S7 to the value to perform underlying stitching, and this value has been stored in ROM 13, a YES decision is obtained in step S11, and the control flow goes to step S11.

In step S11, a segmental underlying stitching area outline n2 is produced for the segmental closed area R2 in which underlying stitches are to be formed. Thus, a segmental underlying stitch area U2 that is defined by the segmental underlying stitch area outline n2 is established, as shown in FIG. 5*c*.

Step S12 is then executed to set or determine the segmental underlying stitching start point and segmental underlying end point used when forming underlying stitches in the segmental underlying stitch area U2 established in step S11. The operation performed in this step will be described with reference to FIG. 4.

Step 121 is initially executed to extract points P2, P3 on the segmental underlying stitch area outline n2, which points are respectively closest to the self-intersecting points A1, A2 of the outline m that are present in the segmental closed area R2.

In step S122, it is determined whether the stitching end point E for the whole area is located in the segmental closed area R2 that was specified in step S8 as being ready to be stitched. Since the stitching end point E is not located in the segmental closed area R2, the control flow goes to step S124 in which point P3 on the segmental underlying stitch area outline n2 that is closest to the "valid" self-intersecting point A2 is selected from points P2, P3 on the segmental underlying stitch area outline n2 that were extracted in step S121, and this point P3 is set to a segmental underlying stitching end point for the segmental underlying stitch area U2. If the stitching end point E is located in the segmental closed area R2, a YES decision is obtained in step S122, and step S123 is then executed so that a point on the segmental underlying stitch area outline n2 that is extracted in step S121, which is the closest point to the stitching end point E, is set to the segmental underlying stitching end point for the segmental stitching area U2.

In step S125, point P2 on the segmental underlying stitch area outline n2 that was extracted in step S121, which is the closest point to the current sewing point, namely, the self-intersecting point A1 of the outline m, is set to the segmental underlying stitching start point for the segmental underlying stitch area U2. In the operation as described so far, setting of the segmental underlying stitching start point and segmental underlying stitching end point is accomplished, and the control flow goes to step S13 shown in FIG. 3.

In step S13, sewing data is produced for performing underlying stitching in the segmental underlying stitch area U2. In this step, underlying stitch data is produced based on the segmental underlying stitching start point and segmental underlying stitching end point determined in step S12. Initially, running stitch data is produced for forming running stitches that connect the self-intersecting point A1 of the outline m as the current sewing point, and the segmental underlying stitching start point P2 of the segmental underlying stitch area U2. Then, sewing data for forming underlying stitches is produced by a similar method to that of the known embroidery data processing apparatus, with the point P2 being regarded as the segmental underlying stitching start point and the point P3 being regarded as the segmental underlying stitching end point. In this example, the direction of underlying stitches is set in advance by the user to the lateral direction as viewed in FIGS. 5*a*–5*c* or FIGS. 8*a*–8*d*. Then, the current sewing point is updated to P3.

Figure 8C:
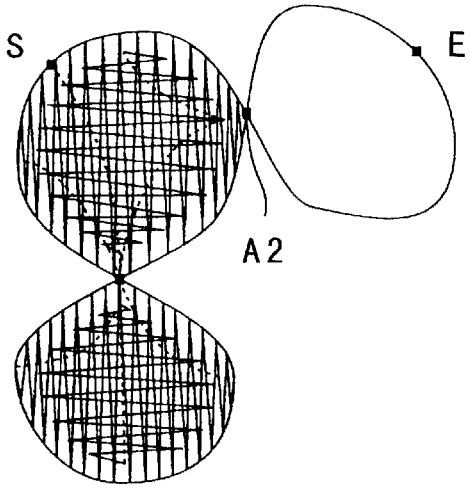

In the next step S14, sewing data is produced so that the interior of the segmental closed area R2 is filled with stitches. In step S14, the segmental stitching starting point and segmental stitching end point for the segmental closed area R2 are set to the self-intersecting point A1 of the outline m and the self-intersecting point A2 of the outline m, respectively, as described above with respect to step S14 in the last cycle. The direction of stitches is set in advance by the user to the direction perpendicular to the direction of underlying stitches in the segmental underlying stitch area U2, namely, the vertical direction as viewed in FIGS. 5*a*–5*c* or FIGS. 8*a*–8*d*. After producing running stitch data for forming running stitches that connect the current sewing point P3 and point A1 as the segmental stitching start point of the segmental closed area R2, sewing data for forming embroidery stitches in the interior of the segmental closed area R2 is produced by a similar method as employed in the known embroidery data processing apparatus. Then, the current sewing point is updated to A2. FIG. 8*c* schematically shows stitches that have been formed at the current point of the control cycle.

In step S15, the management flag of the self-intersecting point A2 of the outline m that is present in the segmental closed area R2 is set to invalid.

In the next step S16, the value of the segmental closed area counter j (=1) is incremented (j=2).

In step S17, it is determined that the value of the segmental closed area counter j (=2) is not equal to the total number N (=3) of the segmental closed areas, and the control flow returns to step S8 as described above.

In step S8 of the flowchart shown in FIG. 3, a segmental closed area that is ready to be stitched next is specified. More specifically, a segmental closed area that has only one "valid" self-intersecting point of the outline m is specified, where the stitching end point E is also regarded as a "valid" self-intersecting point. Namely, in this example, the remaining segmental closed area R3 has the self-intersecting point A2 and the stitching end point E, but only the stitching end point E is counted as the valid point since the management flag of A2 has been set to invalid in step S15 in the last cycle. Accordingly, the segmental closed area R3 is specified as being ready to be stitched next.

In step S9, running stitch data is produced as auxiliary sewing data for forming running stitches from the self-intersecting point A2 of the outline m as the current sewing point to the segmental closed area R3 that was specified in step S8 as being ready to be stitched. Since the self-intersecting point A2 of the outline m is the current sewing point and is located in the segmental closed area R3 in this example, running stitch data as auxiliary sewing data is not necessary and not produced.

Step S10 is then executed to determine whether the segmental closed area R3 that is to be stitched next is set to the value indicating that underlying stitching is to be performed. Since the segmental closed area R3 was set in step S7 to a value that indicates that underlying stitching is not to be performed in this area R3, and this value is stored in RAM 13, a NO decision is obtained in step S10, and the control flow goes to step S14.

Figure 8D:
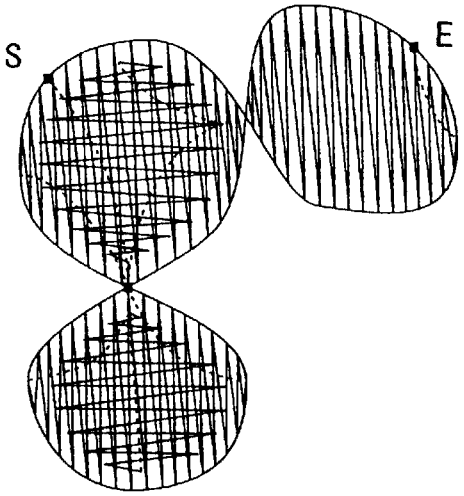

In step S14, sewing data is produced so that the interior of the segmental closed area R3 is filled with stitches. In this step, the segmental stitching starting point and segmental stitching end point for the segmental closed area R3 are set to the self-intersecting point A2 of the outline m and the sewing end point E, respectively, in the manner as described above with respect to step S4 in the previous cycles. It is assumed that the direction of stitches is set in advance by the user to the vertical direction as viewed in FIGS. 5*a*–5*c* or FIGS. 8*a*–8*d*. Thereafter, sewing data for forming embroidery stitches in the interior of the segmental closed area R3 is produced by a similar method as employed in the previously identified and incorporated by reference known embroidery data processing apparatus. In particular, segmental stitches are generated for the segmental closed area with one stitch point being end point E. A running stitch then goes to the final generated stitch point in the segmental closed area and the embroidery stitching is done back to end point E. Then, the current sewing point is updated to the sewing end point E. FIG. 8*d* schematically shows stitches that have been formed at this point of the current cycle.

In step S15, no operation is performed since the segmental closed area R3 has no "valid" self-intersecting point of the outline m. In the next step S16, the value of the segmental closed area counter j (=2) is incremented (=3).

In step S17, it is determined that the value of the segmental closed area counter j (=3) is equal to the total number N (=3) of the segmental closed areas, and the routine of FIG. 3 for producing sewing data is finished.

The sewing data produced as described above is transmitted to the embroidery sewing machine 25 via the output interface 18 and the communication cable 20 as shown in FIG. 2, and an embroidery pattern is produced according to the sewing data.

As described above, where the outline m that defines the shape of an embroidery area intersects with itself, the outline m is divided into a plurality of segmental outlines at the self-intersecting points in step S2, and segmental underlying stitch area outlines that define the shape of areas in which underlying stitches are formed are established in step S11. Then, underlying stitch data for each segmental underlying stitch area is produced in step S13. Thus, the embroidery data processing apparatus of the invention is able to produce sewing data for performing appropriate underlying stitching.

In the operation of step S12, the segmental underlying stitching start point and segmental underlying stitching end point are set for each of the segmental underlying stitch areas. Thus, the apparatus of the invention is able to produce sewing data for performing underlying stitching on each segmental underlying stitch area with improved efficiency.

Immediately after the underlying stitch data for one segmental closed area is produced in step S13, embroidery data for the same segmental closed area is produced in step S14. Thus, the apparatus of the invention is able to produce sewing data with which sewing operations can be performed with high efficiency without going back and forth between different segmental closed areas.

Further, since the segmental closed area on which stitching is ready to be performed is specified one after another in step S8, sewing data thus produced permits continuous and efficient stitching over a plurality of segmental closed areas.

The connecting relationship among a plurality of segmental closed areas is stored in step S6, and running stitch data is produced as auxiliary stitch data in step S9. Thus, sewing data produced according to the invention permits continuous and efficient stitching over a plurality of segmental closed areas.

In the operation of step S7, the dialog box for setting underlying stitching as shown in FIG. 6 is used so that each of a plurality of segmental closed areas can be set to a selected one of two values indicating whether underlying stitching is to be performed in the area, and the set value is stored in RAM 13. Thus, each of the segmental closed areas can be independently set as to whether underlying stitching is to be performed in the area.

Further, the segmental underlying stitch area outline that defines the shape of the underlying stitch area is established in step S11, based on the underlying stitching set value stored in RAM 13 in step S7. Therefore, sewing data for forming underlying stitches can be produced only for the segmental closed areas that are set to be provided with underlying stitches.

Also, the use of the mouse 17 allows the user to select a certain segmental closed area and set the selected area as to whether underlying stitching is to be performed in the area. In this arrangement, where the user judges that underlying stitching is not necessary for a certain segmental closed area having a small area, for example, the segmental closed area can be set so that the underlying stitches will not be formed in this area. This leads to a reduced volume of embroidery data and reduced time required for embroidering.

In the illustrated embodiment, the operation of step S2 of FIG. 3 functions as dividing means of the invention, and the operation of step S11 functions as means for establishing segmental underlying stitch area outlines for the invention. Step S13 functions as underlying stitch data producing means for the invention. Further, step S12 functions as segmental underlying stitching start and end point setting means, and steps S13 and S14 function as means for determining a sewing order in each segmental closed area. In addition, step S8 corresponds to means for determining a sewing order between segmental closed areas, and step S9 functions as auxiliary stitch data producing means for the invention. The dialog box for setting underlying stitching as shown in FIG. 6, corresponds to underlying stitching setting means for the invention, and RAM 13 corresponds to connecting relationship storing means and underlying stitching set value storing means for the invention. The mouse 17 corresponds to selecting means for the invention.

While the embroidery data processing apparatus of the illustrated embodiment is adapted to produce sewing data and transmits the sewing data to the embroidery sewing machine, the apparatus of the invention may be structured to transmit data on outlines, sewing attributes and other data to the embroidery sewing machine, so that sewing data can be produced within the embroidery sewing machine. Thus, the invention may be embodied with various changes or modifications, without departing from the principle of the invention.

What is claimed is:

1. An embroidery data processing apparatus for producing embroidery data used for forming underlying stitches in a closed area that is enclosed by an outline that defines a shape of an embroidery area, comprising:

dividing means for dividing the outline into a plurality of segmental outlines at at least one self-intersecting point, a self-intersecting point being a point at which the outline intersects itself, the segmental outlines defining a plurality of segmental closed areas, respectively, which are connected to each other at the at least one self-intersecting point;

underlying stitch outline setting means for establishing a plurality of segmental underlying stitch area outlines that define respective shapes of a plurality of segmental underlying stitch areas in which underlying stitches are formed, such that each of the segmental underlying stitch areas is located inside a corresponding one of the plurality of segmental closed areas defined by the segmental outlines into which the outline is divided by the dividing means; and underlying stitch data producing means for producing segmental underlying stitch data used for forming underlying stitches in each of the plurality of segmental underlying stitch areas defined by the segmental underlying stitch area outlines.

2. The embroidery data processing apparatus as defined in claim 1, further comprising underlying stitching start and end point setting means for setting a segmental underlying stitching start point and a segmental underlying stitching end point for each of the plurality of segmental underlying stitch areas.

3. The embroidery data processing apparatus as defined in claim 1, further comprising means for determining a sewing order in each of the segmental closed areas, such that immediately after underlying stitches are formed in one of the segmental underlying stitch areas, stitches are formed in one of the segmental closed areas that contains the one of the segmental underlying stitch areas.

4. The embroidery data processing apparatus as defined in claim 1, further comprising means for determining a sewing order between the plurality of segmental closed areas.

5. The embroidery data processing apparatus as defined in claim 1, further comprising:

connecting relationship storing means for storing a connecting relationship between the plurality of segmental closed areas; and auxiliary sewing data producing means for producing auxiliary sewing data used for forming continuous stitches over the plurality of segmental closed areas, based on the connecting relationship between the segmental closed areas stored in the connecting relationship storing means.

6. The embroidery data processing apparatus as defined in claim 1, further comprising:

underlying stitching setting means for setting each of the plurality of segmental closed areas to a selected value that indicates whether underlying stitches are to be formed; and set value storing means for storing the selected value to which said each segmental closed area is set by the underlying stitching setting means.

7. The embroidery data processing apparatus as defined in claim 6, wherein the underlying stitch outline setting means establishes each of the segmental underlying stitch area outlines, based on the selected value stored in the set value storing means with respect to a corresponding one of the segmental closed areas.

8. The embroidery data processing apparatus as defined in claim 6, further comprising selecting means for selecting at least one segmental closed area from the plurality of segmental closed areas.

9. The embroidery data processing apparatus as defined in claim 1, further comprising:

underlying stitching start and end point setting means for setting a segmental underlying stitching start point and a segmental underlying stitching end point for each of the plurality of segmental underlying stitch areas;

means for determining a sewing order in each of the segmental closed areas, such that immediately after underlying stitches are formed in one of the segmental underlying stitch areas, stitches are formed in one of the segmental closed areas that contains the one of the segmental underlying stitch areas;

means for determining a sewing order between the plurality of segmental closed areas;

connecting relationship storing means for storing a connecting relationship between the plurality of segmental closed areas;

auxiliary sewing data producing means for producing auxiliary sewing data used for forming continuous stitches over the plurality of segmental closed areas, based on the connecting relationship between the segmental closed areas stored in the connecting relationship storing means;

underlying stitching setting means for setting each of the plurality of segmental closed areas to a selected value that indicates whether underlying stitches are to be formed; and set value storing means for storing the selected value to which said each segmental closed area is set by the underlying stitching setting means, wherein the underlying stitch outline setting means establishes each of the segmental underlying stitch area outlines, based on the selected value stored in the set value storing means with respect to a corresponding one of the segmental closed areas.

10. A method of producing an embroidery data used for forming underlying stitches in a closed area that is enclosed by an outline that defines a shape of an embroidery area, comprising the steps of:

dividing the outline into a plurality of segmental outlines by at least one self-intersecting point, a self-intersecting point being a point at which the outline intersects with itself, the segmental outlines defining a plurality of segmental closed areas, respectively, which are connected to each other at the at least one self-intersecting point;

establishing a plurality of segmental underlying stitch area outlines that define respective shapes of a plurality of segmental underlying stitch areas in which underlying stitches are formed, such that each of the segmental underlying stitch areas is located inside a corresponding one of the plurality of segmental closed areas defined by the segmental outlines into which the outline is divided; and producing segmental underlying stitch data used for forming underlying stitches in each of the plurality of segmental underlying stitch areas defined by the segmental underlying stitch area outlines.

11. The method of producing an embroidery data as defined in claim 10, further comprising the step of setting a segmental underlying stitching start point and a segmental underlying stitching end point for each of the plurality of segmental underlying stitch areas.

12. The method of producing an embroidery data as defined in claim 10, further comprising the step of determining a sewing order in each of the segmental closed areas, such that immediately after underlying stitches are formed in one of the segmental underlying stitch areas, stitches are formed in one of the segmental closed areas that contains the one of the segmental underlying stitch areas.

13. The method of producing an embroidery data as defined in claim 10, further comprising the step of determining a sewing order between the plurality of segmental closed areas.

14. A storage medium for storing a program to create embroidery stitch data to including underlying stitch data, for an embroidery pattern, the program comprising:

a routine for dividing the outline into a plurality of outline segments, each outline segment containing at least one self-intersecting point, a self-intersecting point defined as a point where the outline crosses itself;

a routine for establishing an inner outline segment within each outline segment of the plurality of outline segments;

a routine for designating inner outline segments to receive underlying stitches;

a routine for producing underlying stitch data for those inner outline segments designated to have underlying stitches; and a routine for producing embroidery stitch data for each outline segment of the plurality of outline segments.

15. The storage medium according to claim 14, wherein the routine for producing underlying stitch data comprises:

a sub-routine for setting a stitching start point and a stitching end point.

16. The storage medium according to claim 14, further comprising:

a routine for establishing a hierarchical relationship between the plurality of outline segments; and a routine to select a first outline segment for the development of embroidery stitches.

17. The storage medium according to claim 16, further comprising:

a routine for designating a start point and an end point for stitching the embroidery pattern, wherein the routine for producing underlying stitch data and the routine for producing embroidery stitch data first prepare data for the first outline segment and then prepare data based upon the hierarchical relationship.

18. The storage medium according to claim 17, further comprising a subroutine for designating the start point and the end point each as a self-intersecting point.

19. The storage medium according to claim 14, further comprising a program for setting a segmental underlying stitching start point and a segmental underlying stitching end point for designated inner outline segments.

20. The storage medium according to claim 19, further comprising a program for establishing a sewing order for the plurality of outline segments.

* * * * *